US010366674B1

(12) United States Patent
Levin

(10) Patent No.: US 10,366,674 B1
(45) Date of Patent: Jul. 30, 2019

(54) DISPLAY CALIBRATION IN ELECTRONIC DISPLAYS

(71) Applicant: Facebook Technologies, LLC, Menlo Park, CA (US)

(72) Inventor: Kieran Tobias Levin, Redwood City, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/391,681

(22) Filed: Dec. 27, 2016

(51) Int. Cl.
*G09G 5/10* (2006.01)
*G09G 3/20* (2006.01)

(52) U.S. Cl.
CPC ..... *G09G 5/10* (2013.01); *G09G 3/2003* (2013.01); *G09G 2320/0626* (2013.01); *G09G 2320/0666* (2013.01); *G09G 2320/0686* (2013.01); *G09G 2320/0693* (2013.01); *G09G 2360/145* (2013.01); *G09G 2360/16* (2013.01)

(58) Field of Classification Search
CPC ..... G09G 5/10; G09G 3/2003; G09G 2320/0626; G09G 2320/0666; G09G 2320/0686; G09G 2320/0693; G09G 2360/145; G09G 2360/16; G09G 2320/0242; G09G 2320/0233; G09G 2320/0295; G09G 2320/029; G09G 2320/0633; G09G 2320/064; G09G 2320/0646; G09G 2320/0653; G09G 2360/14; G09G 2360/148; G09G 2360/147; G09G 2360/142; G09G 3/2051; G09G 3/2055; G09G 2310/0213; G09G 3/622; G09G 3/2018
See application file for complete search history.

(56) References Cited

U.S. PATENT DOCUMENTS 4,824,250 A * 4/1989 Newman ..... G01N 21/88 356/502
5,045,847 A * 9/1991 Tarui ..... B82Y 20/00 345/207
5,185,602 A * 2/1993 Bassetti, Jr. ..... G09G 3/2003 345/692
5,254,981 A * 10/1993 Disanto ..... G09G 3/344 345/107
5,544,268 A * 8/1996 Bischel ..... G02F 1/011 385/16
5,648,796 A * 7/1997 Boursier ..... G09G 3/2055 345/89
5,734,369 A * 3/1998 Priem ..... G09G 5/02 345/597
(Continued)

*Primary Examiner* — Devona E Faulk
*Assistant Examiner* — Charles L Beard
(74) *Attorney, Agent, or Firm* — Fenwick & West LLP

(57) ABSTRACT

A system calibrates luminance of an electronic display. The system includes an electronic display, a luminance detection device, and a controller. The luminance detection device is configured to measure luminance parameters of active sections of the electronic display. The controller is configured to instruct the electronic display to activate sections in a sparse pattern and in a rolling manner and instruct the luminance detection device to measure luminance parameters for each of the active sections in the sparse pattern. The controller generates calibration data based on the measured luminance parameters of sections in the sparse pattern.

16 Claims, 11 Drawing Sheets

(56) References Cited

U.S. PATENT DOCUMENTS 5,812,629 A * 9/1998 Clauser ..... A61B 6/032 378/37
5,877,715 A * 3/1999 Gowda ..... H03M 1/1023 341/118
5,898,168 A * 4/1999 Gowda ..... H04N 5/3532 250/208.1
5,911,018 A * 6/1999 Bischel ..... G02F 1/011 385/11
5,990,950 A * 11/1999 Addison ..... G06T 3/4015 348/273
6,115,066 A * 9/2000 Gowda ..... H04N 5/3575 348/241
6,144,162 A * 11/2000 Smith ..... G09G 3/3208 315/169.1
6,167,169 A * 12/2000 Brinkman ..... G02F 1/011 385/10
6,243,055 B1 * 6/2001 Fergason ..... G02B 5/3083 345/32
6,295,041 B1 * 9/2001 Leung ..... G09G 3/3607 345/694
6,344,877 B1 * 2/2002 Gowda ..... H04N 5/3575 250/208.1
6,459,425 B1 * 10/2002 Holub ..... G01J 3/02 345/204
6,493,029 B1 * 12/2002 Denyer ..... G06T 3/4015 348/236
6,757,445 B1 * 6/2004 Knopp ..... G01C 11/06 382/154
6,882,364 B1 * 4/2005 Inuiya ..... H04N 9/045 348/237
7,043,073 B1 * 5/2006 Holzbach ..... G03H 1/268 345/418
7,218,355 B2 * 5/2007 Zhou ..... G09G 5/363 348/443
8,248,501 B2 * 8/2012 Cieslinski ..... H01L 27/14643 348/302
8,395,565 B2 * 3/2013 Somerville ..... G09G 3/3216 345/204
8,705,152 B2 * 4/2014 Cho ..... H04N 1/62 345/604
8,836,797 B1 * 9/2014 Rykowski ..... G09G 3/006 345/589
9,523,771 B2 * 12/2016 Romano ..... G01S 7/48
9,779,686 B2 * 10/2017 Richards ..... G09G 5/003
9,784,563 B2 * 10/2017 Stanford ..... G01B 11/002
9,805,512 B1 * 10/2017 Katz ..... G06T 19/006
9,880,666 B2 * 1/2018 Kwak ..... G06F 3/0418
10,033,947 B2 * 7/2018 Madurawe ..... H04N 5/355
10,225,468 B2 * 3/2019 Picalausa ..... H04N 1/00
2001/0011982 A1 * 8/2001 Leung ..... G09G 3/3622 345/88
2002/0018073 A1 * 2/2002 Stradley ..... G09G 5/02 345/698
2002/0186309 A1 * 12/2002 Keshet ..... G06T 3/4015 348/272
2003/0198872 A1 * 10/2003 Yamazoe ..... G03F 1/36 430/5
2003/0218592 A1 * 11/2003 Cho ..... G09G 3/3611 345/89
2004/0032403 A1 * 2/2004 Sala ..... G09G 3/3625 345/204
2004/0070565 A1 * 4/2004 Nayar ..... G06K 9/4661 345/156
2004/0146295 A1 * 7/2004 Furman ..... G01N 21/8806 398/9
2004/0183759 A1 * 9/2004 Stevenson ..... G02B 6/43 345/82
2004/0213449 A1 * 10/2004 Safaee-Rad ..... G06T 7/0004 382/141
2004/0233311 A1 * 11/2004 Throngnumchai .... H04N 3/155 348/308
2005/0280766 A1 * 12/2005 Johnson ..... G09G 3/3216 349/167
2006/0007134 A1 * 1/2006 Ting ..... G06F 3/0386 345/156
2006/0108507 A1 * 5/2006 Huang ..... H01L 27/14609 250/208.1
2006/0139469 A1 * 6/2006 Yokota ..... H04N 3/1562 348/272
2006/0176375 A1 * 8/2006 Hwang ..... H04N 9/045 348/222.1
2006/0280360 A1 * 12/2006 Holub ..... G01J 3/02 382/162
2007/0034806 A1 * 2/2007 Hornig ..... G01T 1/24 250/370.08
2007/0063957 A1 * 3/2007 Awakura ..... G02F 1/13318 345/98
2007/0115440 A1 * 5/2007 Wiklof ..... G03B 21/14 353/69
2007/0120794 A1 * 5/2007 Shin ..... G09G 3/3648 345/89
2007/0182897 A1 * 8/2007 Shin ..... G02F 1/13306 349/117
2007/0229766 A1 * 10/2007 Uchiyama ..... G03B 21/28 353/20
2007/0247419 A1 * 10/2007 Sampsell ..... G09G 3/3466 345/108
2008/0049048 A1 * 2/2008 Credelle ..... G09G 3/2074 345/690
2008/0088892 A1 * 4/2008 Cho ..... H04N 1/6027 358/504
2008/0123022 A1 * 5/2008 Aoki ..... G02F 1/133603 349/68
2008/0243415 A1 * 10/2008 Stanford ..... G01B 11/002 702/94
2009/0073185 A1 * 3/2009 Liao ..... G09G 3/3614 345/596
2009/0086081 A1 * 4/2009 Tan ..... G01B 11/25 348/333.1
2009/0122054 A1 * 5/2009 Lee ..... G09G 3/2055 345/214
2009/0122232 A1 * 5/2009 Seki ..... G02F 1/133603 349/68
2009/0153745 A1 * 6/2009 Park ..... H04N 13/0025 348/708
2009/0195563 A1 * 8/2009 Xu ..... G09G 3/2081 345/690
2009/0303227 A1 * 12/2009 Hwang ..... G09G 3/2055 345/214
2010/0053045 A1 * 3/2010 Fish ..... G09G 3/3233 345/82
2010/0149073 A1 * 6/2010 Chaum ..... G02B 27/0093 345/8
2010/0149145 A1 * 6/2010 Van Woudenberg .... G09G 3/34 345/207
2010/0165013 A1 * 7/2010 Yamamoto ..... G09G 3/3413 345/692
2010/0202269 A1 * 8/2010 Lee ..... G11B 7/0065 369/103
2010/0225679 A1 * 9/2010 Guncer ..... G09G 3/2022 345/690
2010/0260409 A1 * 10/2010 Ben-Levy ..... G01B 11/2518 382/141
2010/0317132 A1 * 12/2010 Rogers ..... H01L 25/0753 438/27
2010/0320391 A1 * 12/2010 Antonuk ..... H01L 27/1462 250/366
2010/0322497 A1 * 12/2010 Dempsey ..... G01R 33/4826 382/131
2011/0012879 A1 * 1/2011 Uehata ..... G06F 3/041 345/207
2011/0181635 A1 * 7/2011 Kabe ..... G09G 3/3426 345/694
2011/0242074 A1 * 10/2011 Bert ..... G09G 3/3208 345/207
2011/0254759 A1 * 10/2011 Mori ..... G09G 3/3607 345/88

(56) References Cited

U.S. PATENT DOCUMENTS

2011/0254879 A1* 10/2011 Mori ..... G09G 3/3607 345/690
2012/0012736 A1* 1/2012 Simony ..... H04N 5/3745 250/208.1
2012/0050345 A1* 3/2012 Higashi ..... G09G 3/3426 345/690
2012/0056186 A1* 3/2012 Shirouzu ..... G02F 1/136204 257/59
2012/0127324 A1* 5/2012 Dickins ..... G09G 3/006 348/191
2012/0133765 A1* 5/2012 Matherson ..... H04N 9/045 348/135
2012/0182276 A1* 7/2012 Kee ..... G09G 5/10 345/207
2012/0200615 A1* 8/2012 Tsubata ..... G09G 3/3614 345/690
2012/0223958 A1* 9/2012 Irie ..... G09G 3/2025 345/589
2013/0051553 A1* 2/2013 Cesnik ..... H04N 21/44008 380/200
2013/0106891 A1* 5/2013 Matsueda ..... G09G 3/2003 345/589
2013/0106923 A1* 5/2013 Shields ..... G09G 3/3406 345/690
2013/0153771 A1* 6/2013 Kiesel ..... G08G 1/015 250/353
2013/0170757 A1* 7/2013 Shinoda ..... G06K 9/00 382/209
2013/0207940 A1* 8/2013 Song ..... G09G 3/20 345/204
2013/0241907 A1* 9/2013 Amirparviz ..... G02B 27/0093 345/207
2013/0286053 A1* 10/2013 Fleck ..... G09G 3/3208 345/690
2013/0314447 A1* 11/2013 Wu ..... G09G 5/02 345/690
2014/0002700 A1* 1/2014 Oishi ..... H04N 5/369 348/273
2014/0016829 A1* 1/2014 Chen ..... G06T 7/20 382/107
2014/0043508 A1* 2/2014 Kawamura ..... H04N 5/23212 348/280
2014/0049571 A1* 2/2014 Erinjippurath .... G02F 1/133606 345/690
2014/0049734 A1* 2/2014 Erinjippurath ..... G09G 3/3611 349/96
2014/0078338 A1* 3/2014 Hatano ..... H04N 9/045 348/222.1
2014/0098075 A1* 4/2014 Kwak ..... G06F 3/0487 345/204
2014/0104301 A1* 4/2014 Nakagawa ..... G09G 3/2003 345/589
2014/0137134 A1* 5/2014 Roy ..... G06F 9/5083 718/105
2014/0168482 A1* 6/2014 Herman ..... G06T 5/001 348/241
2014/0176626 A1* 6/2014 Sasaki ..... G09G 3/2051 345/697
2014/0193076 A1* 7/2014 Gardiner ..... G06K 9/46 382/190
2014/0210878 A1* 7/2014 Broughton ..... G09G 3/003 345/694
2014/0229904 A1* 8/2014 Fujimura ..... G03F 1/20 716/54
2014/0267372 A1* 9/2014 Chaji ..... G06T 3/403 345/606
2014/0285629 A1* 9/2014 Okigawa ..... H01L 27/14621 348/46
2014/0285806 A1* 9/2014 Haas ..... G01J 3/522 356/406
2014/0313217 A1* 10/2014 Walley ..... G09G 5/00 345/589
2014/0313380 A1* 10/2014 Aoki ..... H04N 5/3696 348/280
2014/0313387 A1* 10/2014 Vogelsang ..... H04N 5/3696 348/308
2014/0327710 A1* 11/2014 Xu ..... G09G 3/003 345/698
2014/0346460 A1* 11/2014 Kang ..... H01L 27/3279 257/40
2015/0008260 A1* 1/2015 Volfson ..... G01S 17/107 235/404
2015/0090863 A1* 4/2015 Mansoorian ..... H01L 27/1461 250/208.1
2015/0113031 A1* 4/2015 Reinwald ..... G06F 17/16 708/520
2015/0120241 A1* 4/2015 Kadambi ..... G01S 17/89 702/166
2015/0131104 A1* 5/2015 Lim ..... G01B 9/02083 356/479
2015/0233763 A1* 8/2015 Holub ..... G01J 3/46 348/184
2015/0243068 A1* 8/2015 Solomon ..... G02B 27/017 345/419
2015/0278442 A1* 10/2015 Rezaee ..... G06F 19/321 382/128
2015/0285625 A1* 10/2015 Deane ..... G01S 17/10 348/140
2015/0287310 A1* 10/2015 Deliuliis ..... H04W 4/90 340/628
2015/0302570 A1* 10/2015 Shirakyan ..... G06T 7/0051 348/46
2015/0302814 A1* 10/2015 Shiomi ..... G09G 3/3607 345/694
2015/0358646 A1* 12/2015 Mertens ..... H04N 1/6058 382/166
2016/0026253 A1* 1/2016 Bradski ..... G02B 27/225 345/8
2016/0044209 A1* 2/2016 Tsukano ..... H04N 1/60 358/1.9
2016/0080715 A1* 3/2016 Tanaka ..... H04N 5/3696 348/223.1
2016/0125781 A1* 5/2016 Yang ..... G09G 3/2003 345/694
2016/0125798 A1* 5/2016 Park ..... G09G 3/3208 345/690
2016/0203382 A1* 7/2016 Gardiner ..... G06K 9/4633 382/190
2016/0323518 A1* 11/2016 Rivard ..... H04N 5/247
2016/0329016 A1* 11/2016 Chaji ..... G09G 3/3225
2016/0349514 A1* 12/2016 Alexander ..... G06F 3/013
2017/0005156 A1* 1/2017 Kim ..... H01L 27/3262
2017/0032742 A1* 2/2017 Piper ..... G09G 3/3233
2017/0041068 A1* 2/2017 Murakowski ..... H04B 10/11
2017/0047020 A1* 2/2017 Yata ..... G09G 3/3413
2017/0059912 A1* 3/2017 Kim ..... G02F 1/13338
2017/0061903 A1* 3/2017 Yata ..... G09G 3/3413
2017/0069059 A1* 3/2017 Urfalioglu ..... G06T 5/002
2017/0069273 A1* 3/2017 Park ..... G09G 3/3233
2017/0070692 A1* 3/2017 Lin ..... H04N 5/2176
2017/0076654 A1* 3/2017 Wang ..... G09G 3/2074
2017/0092167 A1* 3/2017 Chaji ..... G06T 3/403
2017/0116900 A1* 4/2017 Chaji ..... G09G 3/2003
2017/0117343 A1* 4/2017 Oh ..... G09G 3/3233
2017/0141353 A1* 5/2017 Vronsky ..... H01L 51/0005
2017/0176575 A1* 6/2017 Smits ..... G01S 17/003
2017/0188023 A1* 6/2017 Brabenac ..... H04N 17/02
2017/0201681 A1* 7/2017 Picalausa ..... H04N 1/00
2017/0213355 A1* 7/2017 Hujsak ..... G06T 5/005
2017/0214558 A1* 7/2017 Nazarathy ..... H04L 25/03891
2017/0249906 A1* 8/2017 Noh ..... G09G 3/3266
2017/0261761 A1* 9/2017 Dholakia ..... G02B 27/58
2017/0263893 A1* 9/2017 Kim ..... H01L 51/56
2017/0280122 A1* 9/2017 Sato ..... H04N 9/77
2017/0301280 A1* 10/2017 Ka ..... G09G 3/2092
2017/0307893 A1* 10/2017 Kooi ..... G02B 27/0172
2017/0316754 A1* 11/2017 Katougi ..... G09G 5/06
2017/0322309 A1* 11/2017 Godbaz ..... G01S 17/89
2017/0323429 A1* 11/2017 Godbaz ..... G06T 5/002

(56) References Cited

U.S. PATENT DOCUMENTS

| | | | | |
|---|---|---|---|---|
| 2017/0347120 | A1* | 11/2017 | Chou | H04N 19/597 |
| 2017/0358255 | A1* | 12/2017 | Wang | G09G 3/2055 |
| 2017/0364732 | A1* | 12/2017 | Komogortsev | G06K 9/0061 |
| 2018/0003824 | A1* | 1/2018 | Volfson | G01S 17/58 |
| 2018/0070029 | A1* | 3/2018 | Centen | H04N 5/343 |
| 2018/0070036 | A1* | 3/2018 | Centen | H04N 5/37457 |
| 2018/0094912 | A1* | 4/2018 | Stanford | G01B 11/26 |
| 2018/0113506 | A1* | 4/2018 | Hall | G06F 3/012 |
| 2018/0149874 | A1* | 5/2018 | Aleem | H04N 9/3129 |
| 2018/0151132 | A1* | 5/2018 | Lee | G09G 3/3406 |
| 2018/0151656 | A1* | 5/2018 | Choo | G09G 3/3233 |
| 2018/0159213 | A1* | 6/2018 | Haziza | H01Q 3/44 |
| 2018/0212016 | A1* | 7/2018 | Choi | H01L 27/3276 |
| 2018/0270405 | A1* | 9/2018 | Ota | H04N 5/2358 |
| 2018/0278875 | A1* | 9/2018 | Rotte | H04N 5/347 |
| 2019/0018231 | A1* | 1/2019 | Dixon | G02B 21/002 |
| 2019/0052872 | A1* | 2/2019 | Shyshkin | G01J 1/0228 |

* cited by examiner

500

DISPLAY CALIBRATION IN ELECTRONIC DISPLAYS

BACKGROUND

The present disclosure generally relates to electronic displays, and specifically to calibrating brightness and colors in such electronic displays.

An electronic display includes pixels that display a portion of an image by emitting one or more wavelengths of light from various sub-pixels. Responsive to a uniform input, the electronic display should have uniform luminance. However, during the manufacturing process, various factors cause non-uniformities in luminance of pixels and sub-pixels. For example, variations in flatness of a carrier substrate, variations in a lithography light source, temperature variations across the substrate, or mask defects may result in the electronic display having transistors with non-uniform emission characteristics. As a result, different sub-pixels driven with the same voltage and current will emit different intensities of light (also referred to as brightness). In another example, "Mura" artifact or other permanent artifact causes static or time-dependent non-uniformity distortion in the electronic display, due to undesirable electrical variations (e.g., differential bias voltage or voltage perturbation). Variations that are a function of position on the electronic display cause different display regions of the electronic display to have different luminance. If these errors systematically affect sub-pixels of one color more than sub-pixels of another color, then the electronic display has non-uniform color balance as well. These spatial non-uniformities of brightness and colors decrease image quality and limit applications of the electronic displays. For example, virtual reality (VR) systems typically include an electronic display that presents virtual reality images. These spatial non-uniformities reduce user experience and immersion in a VR environment.

SUMMARY

A system is configured to calibrate luminance parameters (e.g., brightness levels, colors, or both) of an electronic display. For example, the system calibrates luminance parameters (e.g., brightness levels, color values, or both) of an electronic display by activating sections of the electronic display in a sparse pattern and in a rolling manner. Examples of a section include a pixel, a sub-pixel, or a group of pixels included in the electronic display.

In some embodiments, the system includes a luminance detection device and a controller. The luminance detection device is configured to measure luminance parameters of active sections of an electronic display under test. The controller is configured to instruct the electronic display to activate sections in a sparse pattern and in a rolling manner. The sparse pattern includes a plurality of sections in a particular direction (e.g., a vertical direction, or horizontal direction) that are separated from each other by a threshold distance. The sparse pattern is presented in a rolling manner such no two sections, of the plurality of sections, are active over a same time period. The controller instructs the luminance detection device to measure luminance parameters for each of the active sections in the sparse pattern. The controller generates calibration data based on the measured luminance parameters of sections in the sparse pattern. The generated calibration data can include, e.g., a brightness level adjustment to one or more of the sections (e.g., such that corresponding brightness levels of the one or more sections are within a predetermined range of brightness levels), a color value adjustment to one or more of the sections (e.g., such that corresponding color values of the one or more sections are within a predetermined range of color values), or both. The system may then update the electronic device with the generated calibration data.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

System Overview

Figure 1:
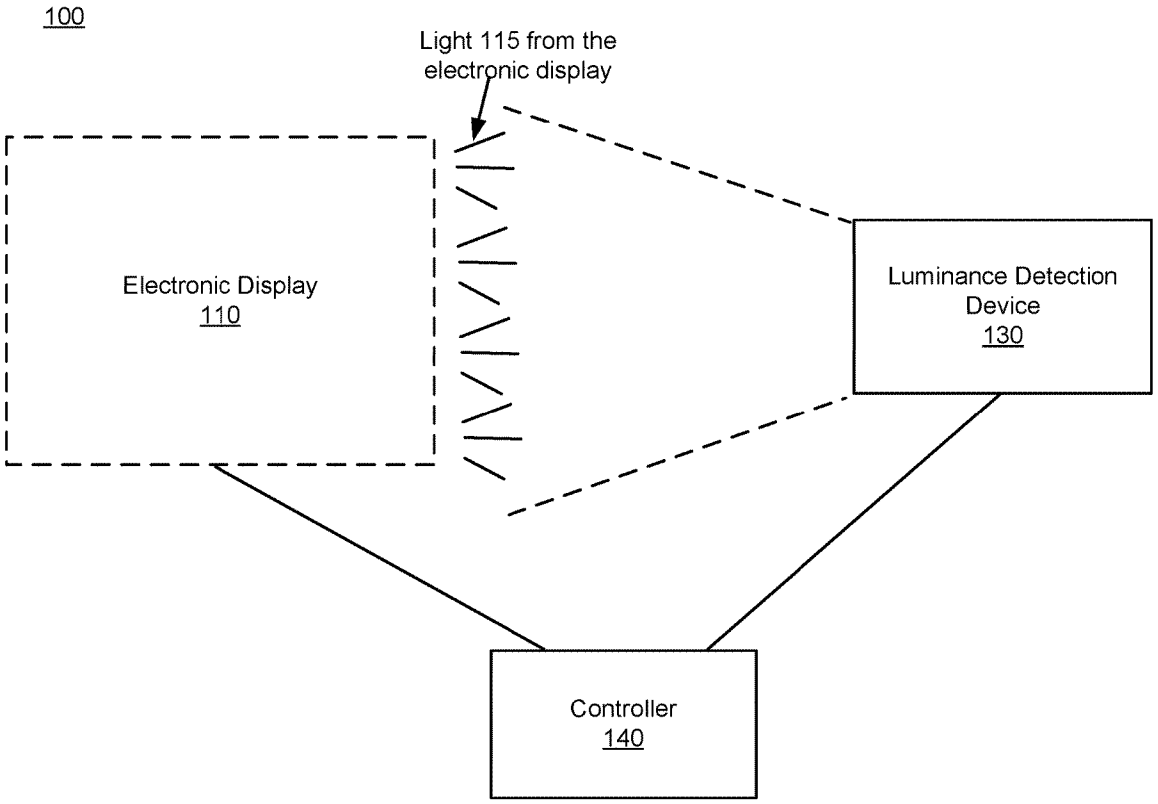
FIG. 1 is a high-level block diagram illustrating an embodiment of a system for calibrating luminance of an electronic display, in accordance with an embodiment.

FIG. 1 is a high-level block diagram illustrating an embodiment of a system 100 for calibrating luminance of an electronic display 110, in accordance with an embodiment. The system 100 shown by FIG. 1 comprises a luminance detection device 130 and a controller 140. While FIG. 1 shows an example system 100 including one luminance detection device 130 and one controller 140, in other embodiments any number of these components may be included in the system 100. For example, there may be multiple luminance detection devices 130 coupled to one or more controllers 140. In alternative configurations, different and/or additional components may be included in the system 100. Similarly, functionality of one or more of the components can be distributed among the components in a different manner than is described here.

In some embodiments, the system 100 may be coupled to an electronic display 110 to calibrate brightness and colors of the electronic display 110. In some embodiments, the system 100 may be coupled to the electronic display 110 held by a display holder. For example, the electronic display 110 is a part of a headset. An example is further described in FIGS. 5A and 5B. Some or all of the functionality of the controller 140 may be contained within the display holder.

The electronic display 110 displays images in accordance with data received from the controller 140. In various embodiments, the electronic display 110 may comprise a single display panel or multiple display panels (e.g., a display panel for each eye of a user in a head mounted display or an eye mounted display). Examples of the electronic display 110 include: a liquid crystal display (LCD), an organic light emitting diode (OLED) display, an electroluminescent display, a plasma display, an active-matrix organic light-emitting diode display (AMOLED), some other display, or some combination thereof.

During a manufacturing process of the electronic display 110 that includes one or more display panels, there may be some non-uniformity that exists across any individual display panel as well as across panels. For example, in a TFT-based electronic display, non-uniformities may arise due to one or more of: threshold voltage variation of TFTs that drive pixels of the display panels, mobility variation of the TFTs, aspect ratio variations in the TFT fabrication process, power supply voltage variations across panels (e.g., IR-drop on panel power supply voltage line), and age-based degradation. The non-uniformities may also include TFT fabrication process variations from lot-to-lot (e.g., from one lot of wafers used for fabricating the TFTs to another lot of wafers) and/or TFT fabrication process variations within a single lot of (e.g., die-to-die variations on a given wafer within a lot of wafers). The nature of non-uniformity could be in either brightness characteristics (e.g., if there are dim portions when displaying a solid single color image) or color characteristics (e.g., if the color looks different when displaying a solid single color image). These non-uniformities may be detected and calibrated as described below in conjunction with FIGS. 2, 3A-3E.

The electronic display 110 includes a plurality of pixels, which may each include a plurality of sub-pixels (e.g., a red sub-pixel, a green sub-pixel, etc.), where a sub-pixel is a discrete light emitting component. For example, by controlling electrical activation (e.g., voltage or current) of the sub-pixel, an intensity of light that passes through the sub-pixel is controlled. In some embodiments, each sub pixel includes a storage element, such as a capacitor, to store energy delivered by voltage signals generated by an output buffer included in the controller 140. Energy stored in the storage device produces a voltage used to regulate an operation of the corresponding active device (e.g., thin-film-transistor) for each sub-pixel. In some embodiments, the electronic display 110 uses a thin-film-transistor (TFT) or other active device type to control the operation of each sub-pixel by regulating light passing through the respective sub-pixel. The light can be generated by a light source (e.g., fluorescent lamp or light emitting diode (LED) in LCD display). In some embodiments, light is generated based in part on one or more types of electroluminescent material (e.g., OLED display, AMOLED display). In some embodiments, the light is generated based in part on one or more types of gas (e.g., plasma display).

Each sub-pixel is combined with a color filter to emit light of corresponding color based on the color filter. For example, a sub-pixel emits red light via a red color filter (also referred to as a red sub-pixel), blue light via a blue color filter (also referred to as a blue sub-pixel), green light via a green color filter (also referred to as green sub-pixel), or any other suitable color of light. In some embodiments, images projected by the electronic display 110 are rendered on the sub-pixel level. The sub-pixels in a pixel may be arranged in different configurations to form different colors. In some embodiments, three sub-pixels in a pixel may form different colors. For example, the pixel shows different colors based on brightness variations of the red, green, and blue sub-pixels (e.g., RGB scheme). In some embodiments, sub-pixels in a pixel are combined with one or more sub-pixels in their surrounding vicinity to form different colors. For example, a pixel includes two sub-pixels, e.g., a green sub-pixel, and alternating a red or a blue sub-pixel (e.g., RGBG scheme). Examples of such arrangement include PENTILE® RGBG, PENTILE® RGBW, or some another suitable arrangement of sub-pixels that renders images at the sub-pixel level. In some embodiments, more than three sub-pixels form a pixel showing different colors. For example, a pixel has 5 sub-pixels (e.g., 2 red sub-pixels, 2 green sub-pixels and a blue sub-pixel). In some embodiments, sub-pixels are stacked on top of one another instead of next to one another as mentioned above to form a pixel (e.g., stacked OLED). In some embodiments, a color filter is integrated with a sub-pixel. In some embodiments, one or more mapping algorithms may be used to map an input image from the controller 140 to a display image.

The luminance detection device 130 measures luminance parameters of sections of the electronic display 110. Examples of a section include a pixel, a sub-pixel, or a group of pixels. The luminance parameters describe parameters associated with a section of the electronic display 110. Examples of the luminance parameters associated with the section include a brightness level, a color, a period of time when the section is active, a period of time when the section is inactive (i.e., not emitting light), other suitable parameter related to luminance of an active section, or some combination thereof. In some embodiments, the number of data bits used to represent an image data value determines the number of brightness levels that a particular sub-pixel may produce. For example, a 10-bit image data may be converted into 1024 analog signal levels generated by the controller 140. A measure of brightness of the light emitted by each sub-pixel may be represented as a gray level. The gray level is represented by a multi-bit value ranging from 0, corresponding to black, to a maximum value representing white (e.g., 1023 for a 10-bit gray level value). Gray levels between 0 and 1023 represent different shades of gray. A 10-bit gray level value allows each sub-pixel to produce 1024 different brightness levels.

In some embodiments, the luminance detection device 130 detects brightness levels (also referred to as brightness values) of one or more sections. For example, the luminance detection device 130 includes a brightness detection device. The brightness detection device can be a photo-detector. The photo-detector detects light 115 from the one or more sections included in the electronic display 110, and converts light received from the one or more sections into voltage or current. Examples of the photo-detector include a photodiode, a photomultiplier tube (PMT), a solid state detector, other suitable detector for detection in one dimension, or some combination thereof. The photo-detector can be coupled with an analog-to-digital converter (ADC) to convert voltage analog signals or current analog signals into digital signals for further processing. The ADC can be included in the controller 140.

In some embodiments, the luminance detection device 130 detects color values of one or more sections. A color value describes a wavelength of light emitted from the one or more sections. The luminance detection device 130 includes a colorimeter, or other suitable detection device to detect color values. The colorimeter collects color values in one or more color spaces. Examples of a color space includes RGB-type color spaces (e.g., sRGB, Adobe RGB, Adobe Wide Gamut RGB, etc.), CIE defined standard color spaces (e.g., CIE 1931 XYZ, CIELUV, CIELAB, CIEUVW, etc.), Luma plus chroma/chrominance-based color spaces (e.g., YIQ, YUV, YDbDr, YPbPr, YCbCr, xvYCC, LAB, etc.), hue and saturation-based color spaces (e.g., HSV, HSL), CMYK-type color spaces, and any other suitable color space information.

In some embodiments, the luminance detection device 130 detects both brightness levels and color values of one or more sections. For example, the luminance detection device includes a colorimeter that can detect both brightness levels and colors. Examples of the colorimeter include a one-dimensional colorimeter (e.g., a single point colorimeter), a spectrometry, other suitable device to detect spectrum of emitted light in one dimension, other suitable device to detect colors in one or more color spaces, or some combination thereof. In another example, the luminance detection device 130 includes a photo-detector combined with different color filters (e.g., RGB color filters, color filters associated with color spaces) to detect both colors and brightness.

The luminance detection device 130 based on a one-dimensional photo-detector (e.g., a single pixel photo-detector, a single point photodiode) or a one-dimensional colorimeter (e.g., a single point colorimeter) allows fast acquisition for each individual pixel with a low computational complexity and cost, compared with two-dimensional photo-detector or two-dimensional colorimeter. In some embodiments, the luminance detection device 130 can include or be combined with an optics block (e.g., Fresnel lens is placed in the front of the luminance detection device 130). The optics block directs light emitted from the one or more sections to the luminance detection device 130. An example is further described in FIG. 5B.

The controller 140 controls both the electronic display 110 and the luminance detection device 130. The controller 140 instructs the electronic display 110 to activate a plurality of sections in a specific manner. The specific manner may be associated with an arrangement of sections to be activated (e.g., the plurality of sections are activated in a sparse pattern), an order of the sections to be activated (e.g., the plurality of sections are activated one by one), duration of the sections to be activated, other suitable manner affecting activation of sections, or some combination thereof. The controller 140 may instruct the luminance detection device 130 to measure luminance parameters for one or more of the sections in the specific manner.

The controller 140 calibrates the electronic display 110 based on luminance parameters measured by the luminance detection device 130. The calibration process involves providing known (e.g., predetermined) and uniform input to the electronic display 110. A uniform input may be, e.g., instructions for the electronic display 110 to emit a white image (e.g., equal red, green, blue outputs) with equal brightness levels for each individual pixel. The predetermined input includes predetermined luminance parameters, e.g., brightness level and color value for each individual sub-pixel in a pixel, brightness level and color value for each individual pixel, or some combination thereof. The controller 140 determines calibration data based on differences between the measured luminance parameters of one or more sections in the specific manner and corresponding predetermined luminance parameters. The calibration data describes data associated with one or more adjustments (e.g., brightness adjustment, color adjustment, or both) of luminance parameters of the sections. An adjustment adjusts a luminance parameter of one or more sections such that the corresponding luminance parameter of the one or more sections is within a range of luminance parameters (e.g., a range of brightness levels, or a range of color values, or both). The range of luminance parameters describes a range over which an adjusted luminance parameter and a corresponding predetermined luminance parameter share the same value. For example, a range of brightness levels describes a range over which an adjusted brightness level and a corresponding predetermined brightness level share the same value. Similarly, a range of color values describes a range over which an adjusted color and a corresponding predetermined color share the same value. The determined calibration data may include a correction voltage corresponding to TFT driving the one or more sections in the specific manner, where the correction voltage represents a change in a drive voltage of the TFT to correct differences between the measure luminance parameters of the one or more sections and the corresponding predetermined luminance parameters. In some embodiments, the controller 140 calibrates the electronic display 110 based on luminance parameters measured by the luminance detection device 130 at a sub-pixel level. The controller 140 updates the electronic display 110 with the determined calibration data.

In some embodiments, the controller 140 may receive display data from an external source over a display interface. The display data includes a plurality of frames having predetermined luminance parameters. The controller 140 instructs the electronic display 110 to display the display data. The display interface supports signaling protocols to support a variety of digital display data formats, e.g., display port, and HDMI (High-Definition Multimedia Interface).

Display Control and Calibration

Figure 2:
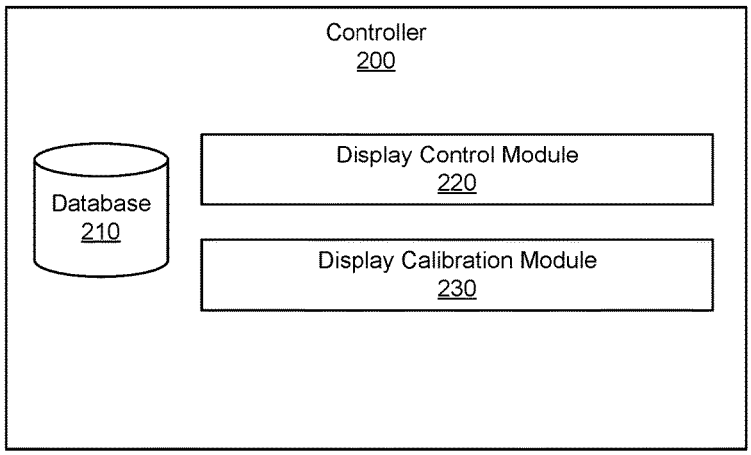
FIG. 2 is a block diagram of a controller for calibrating luminance of an electronic display, in accordance with an embodiment.

FIG. 2 is a block diagram of a controller 200 for calibrating luminance of an electronic display 110, in accordance with an embodiment. In the embodiment shown in FIG. 2, the controller 200 includes a database 210, a display control module 220, and a display calibration module 230. In some embodiments, the controller 200 is the controller 140 of the system 100. In alternative configurations, less, different and/or additional entities may also be included in the controller 200, such as drivers (e.g., gate drivers, and/or source drivers) to drive sub-pixels, and another controller (e.g., a timing controller) to receive display data and to control the drivers. In some embodiments, the controller 200 may include an interface module to receive display data from an external source, and to facilitate communications among the database 210, the display control module 220, and the display calibration module 230.

The database 210 stores information used to calibrate one or more electronic displays. Stored information may include, e.g., display data with predetermined luminance parameters for calibration, other type of display data, data generated by the display control module 220 and a calibration lookup table (LUT), or some combination thereof. The calibration LUT describes correction factors associated with luminance parameters of a plurality of sections (e.g., one or more portions of pixels included in the electronic display, or all pixels included in the electronic display). The correction factors are used to correct variations between measured luminance parameters and corresponding predetermined luminance parameters of a same pixel, e.g., a correction voltage corresponding to TFT driving the pixel. In some embodiments, the calibration LUT may also include measured luminance parameters of individual pixel, and predetermined luminance parameters of corresponding sections. In some embodiments, the database stores a priori (e.g., a calibration LUT from a factory, or other suitable priori at the factory during manufacturing process).

The display control module 220 controls an electronic display and a luminance detection device. The display control module 220 generates instructions to instruct the electronic display to activate sections included in the electronic display in a sparse pattern and in a rolling manner. For example, the display control module 220 may generate display data including the sparse pattern. The display control module 220 converts the display data to analog voltage levels, and provides the analog voltage levels to activate sections associated with the sparse pattern in the rolling manner. In some embodiments, the display control module 220 may receive the display data including the sparse pattern from the external source via the display interface.

The sparse pattern includes a plurality of sections in a particular direction that are separated from each other by a threshold distance. In some embodiments, examples of a section include a pixel, a group of pixels, a sub-pixel, or a group of sub-pixels. Examples of particular direction include a vertical direction, a horizontal direction, a diagonal direction, or other suitable direction across the electronic display. In some embodiments, if the section includes a pixel, the sparse pattern includes a plurality of pixels in a single column that are separated from each other by a threshold distance. For example, any two adjacent pixels in a single column are separated from each other by an interval distance. An example is further described in FIG. 3A.

Display of sections in a rolling manner presents portions of the sparse pattern such that no two sections, of the plurality of sections, are active over a same time period. Display of sections in a rolling manner allows each section of the plurality of active sections being individually displayed. For example, the display controller module 220 instructs the electronic display to activate a section A of the plurality of sections for a period of time A, and then to stop activating the section A, and then to activate a section B of the plurality of sections for a period of time B, and then to stop activating the section B. The process is repeated until all sections in the plurality of sections are activated. The period of time for each section in the plurality of sections may be the same (e.g., the period of time A is equal to the period of time B). An example is further describe in detail below with regard to FIG. 3A. In some embodiments, the period of time for each section of the plurality of sections includes at least a period of time for one section is different from periods of time for other sections of the plurality of sections (e.g., the period of time A is different from the period of time B).

Due to the rolling manner, only one section is active at any given time and is measured for calibration. In such way, it allows using one-dimensional photo-detector (e.g., a single pixel photo-detector, a single point photodiode) or a one-dimensional colorimeter (e.g., a single point colorimeter) for fast acquisition with a low computational complexity and cost, and for more accurate calibration without light interference from other pixels.

In some embodiments, display of sections in a rolling manner presents the plurality of sections in the sparse pattern in a sequential manner. For example, the section A, the section B, and remaining sections of the plurality of section in the above example are next to each other sequentially in the sparse pattern. The section A is the first section located in one side of the sparse pattern. The section B is the second section next to the section A in the spares pattern, and so forth. An example is further describe in detail below with regard to FIG. 3A.

In some embodiments, display of sections in a rolling manner presents the plurality of sections in the sparse pattern in a random manner. The random manner indicates at least two sections sequentially displayed of the plurality of sections are not next to each other in the sparse pattern. For example, the section A and the section B are not next to each other.

The display control module 220 generates instructions to instruct the luminance detection device to measure luminance parameters for each of the sections in the sparse pattern. Due to display of sections in a rolling manner, the luminance detection device is able to detect light emitted from an active section only without light interference from other sections. In such way, the display calibration module 220 provides more accurate calibration.

In some embodiments, the display control module 220 instructs the electronic display to display data with predetermined luminance parameters for calibration. For example, the display control module 220 instructs the electronic display to display a predetermined image with predetermined brightness level and color for each individual pixel, and predetermined brightness level and color for each individual sub-pixel. In the simplest case, the display control module 220 instructs the electronic display to display a uniform image (e.g., a white image) with equal brightness level for each individual pixel and each individual sub-pixel.

To calibrate all pixels included in the electronic display, the display control module 220 generates instructions to instruct the electronic display to activate all pixels by shifting an initial sparse pattern and detect luminance parameters of active pixels accordingly. Examples of shifting the sparse pattern include shifting the initial sparse pattern by one or more sections in a horizontal direction, shifting the initial sparse pattern by one or more sections in a vertical direction, or some combination thereof. In some embodiments, if the shifting direction is different from the direction of the initial sparse pattern, the length of the shifted sparse pattern is the same as the length of the initial sparse pattern, but with different positions. This type of sparse pattern associated with the initial spares pattern is called an A-type sparse pattern. If the shifting direction is the same as the direction of the initial sparse pattern, the length of the shifted sparse pattern is less than the length of the initial sparse pattern. This type of sparse pattern associated with the initial sparse pattern is called a B-type of sparse pattern. For example, the length of the shifted sparse pattern plus the length of the shifted one or more sections equals the length of the initial sparse pattern. An example for activating and detecting all pixels by shifting an initial sparse pattern is described below.

For example, an initial sparse pattern includes a plurality of sections in a vertical direction that are separated from each other by a threshold distance (e.g., 30 pixels or more). In some embodiments, an interval distance between two adjacent sections in the first sparse pattern is different. In one embodiment, in order to calibrate all the pixels included in the electronic display, steps are performed as following:

Step 1: the display control module 220 instructs the electronic display to activate sections in the initial sparse pattern located in a first position of the electronic display (e.g., one end of the electronic display in a horizontal direction) and in the rolling manner. While an active section in the initial sparse pattern is displayed, the display control module 220 instructs the luminance detection device to measure luminance parameters for the corresponding active section. An example for presenting the initial sparse pattern in the rolling is further described in FIG. 3A.

Step 2: the display control module 220 shifts the initial sparse pattern by one or more sections in a horizontal direction to generate a first A-type sparse pattern. The display control module 220 instructs the electronic display to activate sections in the A-type sparse pattern and in a rolling manner. While an active section in the first A-type sparse pattern is displayed, the display control module 220 instructs the luminance detection device to measure luminance parameters for the corresponding active section. The process is repeated until last section of a shifted A-type sparse pattern located in a final position (e.g., the other end of the electronic display in the horizontal direction) is detected. An example based on a section including a pixel is further described in 320A of FIG. 3A. An example based on a section including a sub-pixel is further described in FIGS. 3B-3D.

Step 3: the display control module 220 shifts the initial sparse pattern by one or more sections in a horizontal direction t to generate a first B-type sparse pattern. The display control module 220 updates the initial sparse pattern using the first B-type sparse pattern.

Step 4: Steps 1 to 3 are repeated until a section including a last inactivated pixel of the electronic display is detected. An example based on a section including a pixel is further described in 320B and 320M of FIG. 3A. An example based on a section including a sub-pixel is further described in FIGS. 3B-3D.

The display control module 220 generates display data associated with a series of sparse patterns. The series of sparse patterns includes the initial sparse pattern and shifted sparse patterns. For example, the display data includes a series of frames each having one sparse pattern from the series of sparse patterns. An example based on frames for displaying is further described in FIG. 3. In some embodiments, the display control module 220 may receive the display data with the series of sparse patterns from the external source via the display interface.

In some embodiments, the sparse pattern includes a single section. The display control module 220 generates instructions to instruct the electronic display to activate the single section in a global manner. For example, the display control module 220 activates a first single section included in an initial sparse pattern for a period of time. The display control module 220 instructs the luminance detection device to measure luminance parameters for the first single section in the initial sparse pattern. The display control module 220 shifts the initial sparse pattern by one or more sections in a particular direction (e.g., vertical direction, or horizontal direction) to generate a second sparse pattern including a second single section. The display control module 220 instructs the electronic display to activate the second single section in the second sparse pattern. This process is repeated until the luminance detection device has measured luminance parameters of all the pixels included in the electronic display.

The display calibration module 230 determines calibration data based on differences between the measured luminance parameters of an active section in the electronic display and corresponding predetermined luminance parameters of the active section. For example, the display calibration module 230 retrieves predetermined luminance parameters and measured luminance parameters of the active section stored in the database 210. The display calibration module 230 compares the measured luminance parameters of the active section with corresponding predetermined luminance parameters of the active section. The display calibration module 230 calculates differences between the measured luminance parameters of the active section and corresponding predetermined luminance parameters of the active section. The display calibration module 230 determines the calibration data based on the calculated differences. For example, the display calibration module 230 determines a correction drive voltage of the TFT that drives the active section to reduce the difference within an acceptable range. The display calibration module 230 updates the electronic display 110 with the determined calibration data. For example, the display calibration module 230 passes the calibration data of an active section to the display control module 220. The display control module 220 instructs the electronic display to display the active section based on the calibration data In some embodiments, the display calibration module 230 determines calibration data used for brightness level of active sections in response to the luminance detection device that detects brightness levels only. The display calibration module 230 compares the measured brightness level of an active section with corresponding predetermined brightness level of the active section. The display calibration module 230 calculates differences between the measured brightness level of the active section and corresponding predetermined brightness level of the active section. The display calibration module 230 determines the calibration data based on the calculated differences. An example is further described in FIG. 3E.

In some embodiments, the display calibration module 230 determines calibration data for colors of active sections in response to the luminance detection device that detects colors only. The display calibration module 230 compares the measured color of an active section with corresponding predetermined color of the active section. The display calibration module 230 calculates differences between the measured color of the active section and corresponding predetermined color of the active section. The display calibration module 230 determines the calibration data based on the calculated differences.

In some embodiments, the display calibration module 230 determines calibration data for both brightness levels and colors of active sections in response to the luminance detection device that detects both brightness levels and colors information. In one embodiment, the display calibration module 230 balances calibration data of brightness and color to adjust both brightness levels and color of an active section such that an adjusted brightness level and a value of color values are within an acceptable range. For example, the display calibration module 230 determines calibration data of brightness level of an active section first, and then determines calibration data of color of the active section based in part on the calibration data of brightness level to adjust the color such that an adjusted value of color value of the active section is within a range of values, meanwhile to maintain the adjusted brightness level within a range of brightness levels. Similarly, the display calibration module 230 determines calibration data of color of an active section first, and then determines calibration data of brightness level of the active section based in part on the calibration data of color. In some embodiments, the display calibration module 230 weights calibration data of the brightness level and the color value of an active section. If brightness predominates over color, the display calibration module 230 determines higher weights for calibration data of brightness level than calibration data of color value, and vice versa. An example is further described in FIG. 3F.

In some embodiments, the display calibration module 230 determines a check step to check whether or not differences between calibrated luminance parameters of the active section and corresponding predetermined luminance parameters are within the acceptable range. For example, the display calibration module 230 updates the electronic display 110 with the determined calibration data of the active section. The display control module 220 instructs the electronic display to display the active section based on the calibration data and instructs the luminance detection device to detect luminance parameters of the active section. The display calibration module 230 calculates differences between measured calibrated luminance parameters of the active section and predetermined luminance parameters. In some embodiments, the display calibration module 230 determines a luminance quality to check how close the measured calibrated luminance parameters of the active section are to the corresponding predetermined luminance parameters of the active section. If the luminance quality indicates that a difference between the measured luminance parameters of the active section with corresponding predetermined luminance parameters of the active section is within an acceptable range, the display calibration module 230 does not generate calibration data for the active section. If the luminance quality indicates that the measured luminance parameters of the active section deviate from corresponding predetermined luminance parameters of the section more or less than an associated threshold, the display calibration module 230 determines calibration data based on the measured luminance parameters of the active section.

In some embodiments, the display calibration module 230 calibrates all pixels included in the electronic display. For example, the display calibration module 230 determines calibration data in response to all sections measured by the luminance detection device If the luminance quality indicates that a difference between the measured luminance parameters of an active section with corresponding predetermined luminance parameters of the active section is within a range of luminance parameters, the display calibration module 230 determines calibration data that that does not affect luminance parameters of the corresponding sections (e.g., the calibration data is the same as original data for driving the active section).

In some embodiments, the display calibration module 230 calibrates portions of pixels included in the electronic display based on the luminance quality. For example, the display calibration module 230 determines calibration data for sections to be calibrated. If the luminance quality indicates that the measured luminance parameters of the active section deviate from corresponding predetermined luminance parameters of the active section more or less than an associated threshold, the display calibration module 230 determines calibration data based on calculated differences between the measured luminance parameters of the active section and the corresponding predetermined luminance parameters of the active section. If the luminance quality indicates that a difference between the measured luminance parameters of an active section with corresponding predetermined luminance parameters of the active section is within an acceptable range, the display calibration module 230 does not determine calibration data for the active section. The display control module 220 instructs the electronic display to activate a next section in the sparse pattern. In such way, the display calibration module 230 only determines calibration data corresponding to portions of pixels with luminance quality indicating the measured luminance parameters of the pixels deviate from corresponding predetermined luminance parameters more or less than an associated threshold.

In some embodiments, the display calibration module 230 creates a calibration LUT based on determined calibration data for the sections in the electronic display. The created calibration LUT includes measured luminance parameters of individual section, predetermined luminance parameters of corresponding sections, and correction factors associated with the luminance parameters of corresponding sections. The correction factors are used to correct variations between the measured luminance parameters and predetermined luminance parameters of a same section, e.g., a correction voltage corresponding to TFT driving the section. The created calibration LUT is stored in the database 210.

In some embodiments, the display calibration module 230 determines calibration data based on previous calibration map LUT for the electronic display retrieved from the database 210. In some embodiments, the display calibration module 230 determines calibration data based on a priori (e.g., at the factory during manufacturing process) stored in the database 210. In some embodiments, the display calibration module 230 determines calibration data to change the display data values corresponding to the sections instead of changing the analog drive voltages of the TFTs that drive the sections. For example, the calibration data indicates that a section needs to increase brightness level by 10% to be equal to the predetermined brightness for the same section. Instead of correcting the drive voltage of the TFT that drive the section, the brightness level of the display data value can be increased by 10%.

In some embodiments, calibration data is determined by a user based on measured luminance parameters and predetermined luminance parameters. The user may also adjust luminance parameters based on the calibration data for corresponding sections.

Examples of Display Control and Calibration

Figure 3A:
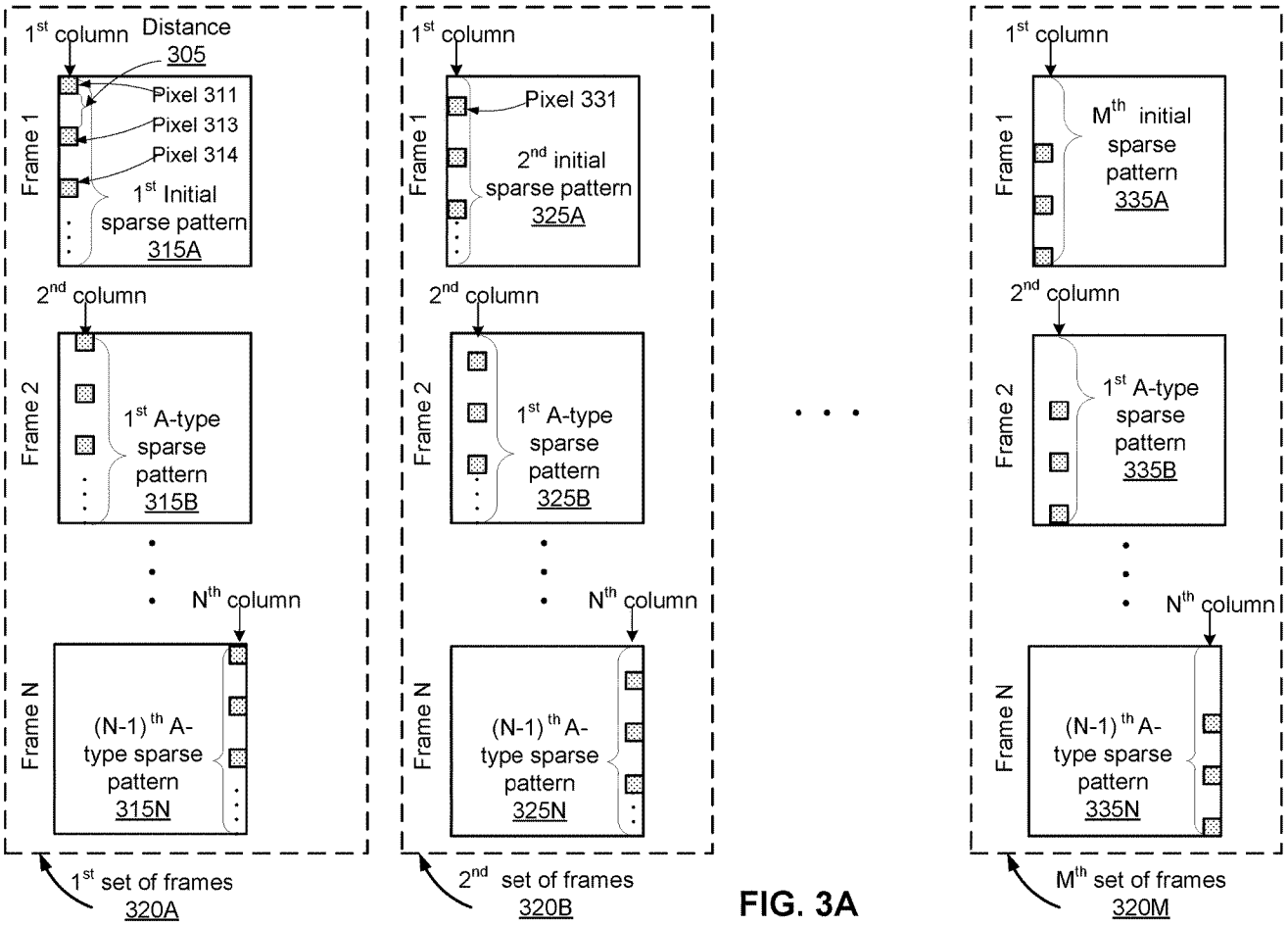
FIG. 3A is an example of a series of sparse patterns used in a plurality of sets of frames for sequentially activating all pixels within an electronic display in a rolling manner, in accordance with an embodiment.

FIG. 3A is an example of a series of sparse patterns (e.g., $1^{st}$ initial sparse pattern 315A, A-type sparse patterns 315B-315N based on the $1^{st}$ initial sparse pattern 315A, $2^{nd}$ initial sparse pattern 325A, A-type sparse patterns 325B-325N based on the $2^{nd}$ initial sparse pattern 325A, . . . , $M^{th}$ initial sparse pattern 335A, A-type sparse patterns 335B-335N based on the $M^{th}$ initial sparse pattern 335A) used in a plurality of sets of frames (e.g., $1^{st}$ set of frames 320A, $2^{nd}$ set of frames 320B, . . . , $M^{th}$ set of frames 320M) for sequentially activating all pixels within an electronic display 110 in a rolling manner, in accordance with an embodiment. As mentioned earlier, a sparse pattern includes a plurality of sections in a particular direction that are separated from each other by a threshold distance. In the embodiment shown in FIG. 3A, a section includes a pixel and the particular direction is a vertical direction. For example, a $1^{st}$ initial sparse pattern 315A includes a plurality of pixels in a single column that are separated from each other by an interval distance 305 (e.g., a distance between a pixel 311 and a pixel 313). The number M represents the last initial sparse pattern for activating pixels or last frame set for activating pixels. The number N is equal to the number of columns included in a frame or included in the electronic display 110.

The series of sparse patterns shown in 320A includes M initial sparse patterns each determining (N−1) A-type sparse patterns. For example, as shown in 320A-320M of FIG. 3A, the $1^{st}$ initial sparse pattern 315A is located on a left end of Frame 1 in a $1^{st}$ set of frames 320A. A $2^{nd}$ initial sparse pattern 325A is determined by shifting the $1^{st}$ initial sparse pattern 315 A in a vertical direction by one pixel such that a first pixel 331 of the $2^{nd}$ sparse pattern is next to the first pixel 311 of the $1^{st}$ initial sparse pattern. A $3^{rd}$ initial sparse pattern is determined by shifting the $2^{nd}$ initial sparse pattern, and so forth (not shown in FIG. 3A). An $M^{th}$ initial sparse pattern is determined by shifting the $(M-1)^{th}$ initial sparse pattern in the vertical direction by one pixel. Each initial sparse pattern determines (N−1) A-type sparse patterns. For example, as shown in 320A of FIG. 3A, a first A-type sparse pattern 315B is determined by shifting the $1^{st}$ initial sparse pattern in a horizontal direction by one pixel to generate the $1^{st}$ A-type sparse pattern 315B such that the $1^{st}$ A-type sparse pattern 315B is located on the $2^{nd}$ column. A second A-type sparse pattern is determined by shifting the $1^{st}$ initial sparse pattern 315A to the $3^{rd}$ column, and so forth (not shown in FIG. 3A). A $(N-1)^{th}$ A-type sparse pattern 315N is determined by shifting the $1^{st}$ initial sparse pattern 315 to the $N^{th}$ column. Similarly, (N−1) A-type sparse patterns (325B-325N) are determined by shifting the $2^{nd}$ initial sparse pattern. (N−1) A-type sparse patterns (335B-335N) are determined by shifting the $M^{th}$ initial sparse pattern.

The plurality of sets of frames shown in FIG. 3A includes M sets of frames each set having an initial sparse pattern and corresponding A-type sparse patterns. For example, as shown in 320A of FIG. 3A, Frame 1 includes the $1^{st}$ initial sparse pattern. Frame 2 includes the $1^{st}$ A-type sparse pattern 315B. Frame 3 includes the $2^{nd}$ A-type sparse pattern (not shown in FIG. 3A), and so forth. The last Frame N includes $(N-1)^{th}$ A-type sparse pattern.

To detect all the pixels included in the electronic display 110, the display control module 220 performs steps as following:

Step 1: The display control module 220 activates pixels in Frame 1 of the $1^{st}$ set of frames 320A in a rolling manner, and instructs luminance detection device to measure luminance parameters of the active pixels. For example, the display control module 220 instructs the electronic device to activate the first pixel 311 in the $1^{st}$ initial sparse pattern 315A for a first period of time, and de-activates remaining pixels included in the electronic display 110. The display control module 220 instructs the luminance detection device to measure the luminance parameters of the pixel 311 during the first period of time. The display control module 220 then stops activating the pixel 311. The display control module 220 activates the second pixel 313 in the $1^{st}$ initial sparse pattern 315A for a second period of time. The display control module 220 instructs the luminance detection device to measure the luminance parameters of the second pixel 313 during the second period of time. The display control module 220 then instructs the electronic display to stop activating the pixel 313. The rolling and measuring process is repeated for the Frame 1 until the last pixel included in the $1^{st}$ initial sparse pattern is activated and measured.

Step 2: the display control module 220 shifts the $1^{st}$ initial sparse pattern in the horizontal direction by one pixel to generate the $1^{st}$ A-type sparse pattern 315B. The display control module 220 instructs the electronic display to activate pixels in the first A-type sparse pattern 315B included in the Frame 2 and in the rolling manner, and instructs luminance detection device to measure luminance parameters of the active pixels. The rolling process is repeated for the Frame 2 until the last pixel included in the $1^{st}$ A-type sparse pattern is activated and measured. The horizontal shifting process is repeated until the last pixel of the $(N-1)^{th}$ A-type sparse pattern is detected.

Step 3: the display control module 220 shifts the $1^{st}$ initial sparse pattern 315A by one pixel in the horizontal direction to generate a first B-type sparse pattern. The display control module 220 updates the $1^{st}$ initial sparse pattern using the generated first B-type sparse pattern as the $2^{nd}$ sparse pattern 325A.

Step 4: Steps 1 to 3 are repeated until the last inactivated pixel of the electronic display 110 is activated and measured. For example, the display control module 220 activates pixels in Frame 1 of the $2^{nd}$ set of frames 320B in the rolling manner, and instructs luminance detection device to measure luminance parameters of the active pixels. The display control module 220 shifts the $2^{nd}$ initial sparse pattern in the horizontal direction by one pixel to generate the $1^{st}$ A-type sparse pattern 325B associated with the $2^{nd}$ initial sparse pattern. The display control module 220 instructs the electronic display to activate pixels in the first A-type sparse pattern 325B and in the rolling manner, and instructs luminance detection device to measure luminance parameters of the active pixels. The display control module 220 shifts the $2^{nd}$ initial sparse pattern 325A by one pixel in the horizontal direction to generate a second B-type sparse pattern. The display control module 220 updates the $2^{nd}$ initial sparse pattern 325 A using the generated second B-type sparse pattern as a $3^{rd}$ initial sparse pattern.

Figure 3B:
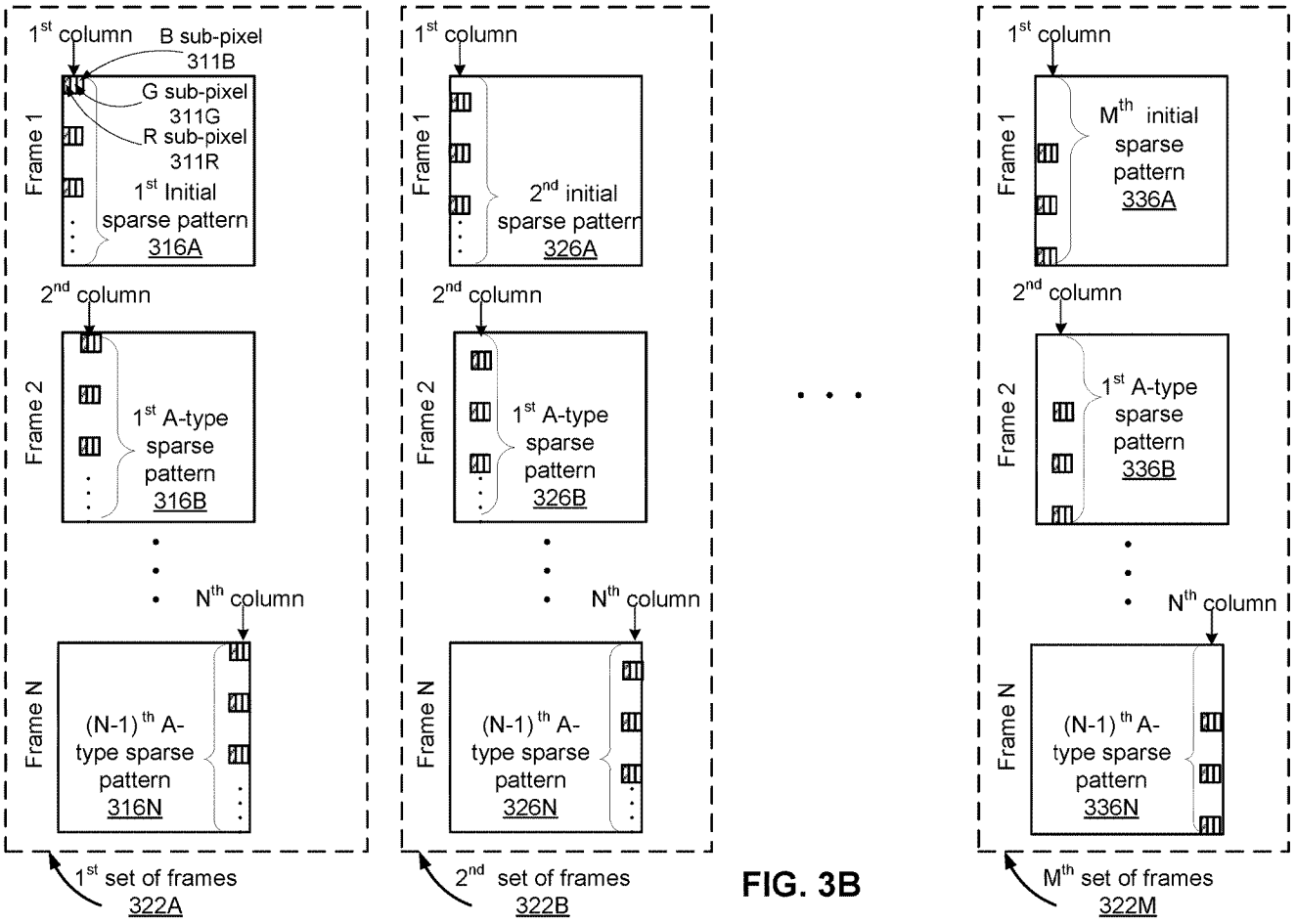
FIG. 3B is an example of a series of sparse patterns used in a plurality of sets of frames for sequentially activating all red sub-pixels within an electronic display in a rolling manner, in accordance with an embodiment.

FIG. 3B is an example of a series of sparse patterns ($1^{st}$ initial sparse pattern 316A, A-type sparse patterns 316B-316N based on the $1^{st}$ initial sparse pattern 316A, $2^{nd}$ initial sparse pattern 326A, A-type sparse patterns 326B-326N based on the $2^{nd}$ initial sparse pattern 326A, . . . , $M^{th}$ initial sparse pattern 336A, A-type sparse patterns 336B-336N based on the $M^{th}$ initial sparse pattern 336A) used in a plurality of sets of frames (e.g., $1^{st}$ set of frames 322A, $2^{nd}$ set of frames 322B, . . . , $M^{th}$ set of frames 322M) for sequentially activating all red sub-pixels within the electronic display 110 in a rolling manner, in accordance with an embodiment. In the embodiment shown in FIG. 3B, a red sub-pixel 311R, a green sub-pixel 311G, and a blue sub-pixel 311B form the pixel 311. Compared with FIG. 3A, a section included in a sparse pattern is a red sub-pixel. For example, a $1^{st}$ initial sparse pattern 316A includes a plurality of red sub-pixels in a single column that are separated from each other by an interval distance. To detect all red sub-pixels included in the electronic display 110, similar steps to FIG. 3A are performed as following 1) Step 1: the display control module 220 instructs the electronic display 110 to activate red sub-pixels (as shown in hatch lines) in Frame 1 of the $1^{st}$ set of frames in a rolling manner. The display control module 220 instructs a luminance detection device to measure luminance parameters of each active red sub-pixel. For example, the display control module 220 instructs the electronic device to activate a first red sub-pixel 311R corresponding to the $1^{st}$ initial sparse pattern for a first period of time, and de-activates remaining sub-pixels included in the first pixel 311 and other pixels included the electronic display 110. The display control module 220 instructs the luminance detection device to measure the luminance parameters of the first red sub-pixel 311R during the first period of time. The display control module 220 then instructs the electronic device to stop activating the red sub-pixel 311R. The rolling and measuring process is repeated for Frame 1 of the $1^{st}$ set of frames 322A until the last red sub-pixel in the $1^{st}$ initial sparse pattern is activated and measured. 2) Step 2: the display controller module 220 shifts the $1^{st}$ initial sparse pattern 316A in the horizontal direction by one pixel to generate the $1^{st}$ A-type sparse pattern 316B. The display control module 220 instructs the electronic display 305 to activate red sub-pixels in the $1^{st}$ A type sparse pattern and in a rolling manner, and instructs luminance detection device to measure luminance parameters of the active red sub-pixels. The rolling and measuring process is repeated for Frame 2 until the last red sub-pixel in the $1^{st}$ A-type sparse pattern is activated and measured. The horizontal shifting process is repeated until the last red sub-pixel of the $(N-1)^{th}$ A-type sparse pattern is detected. 3) Step 3: the display control module 220 shifts the $1^{st}$ initial sparse pattern 316A by one pixel in the horizontal direction to generate a first B-type sparse pattern. The display control module 220 updates the $1^{st}$ initial sparse 316A using the generated first B-type sparse pattern as the $2^{nd}$ sparse pattern 326A. 4) Step 4: Steps 1 to 3 are repeated until the last inactivated red sub-pixel of the electronic display 110 is activated and measured.

Figure 3C:
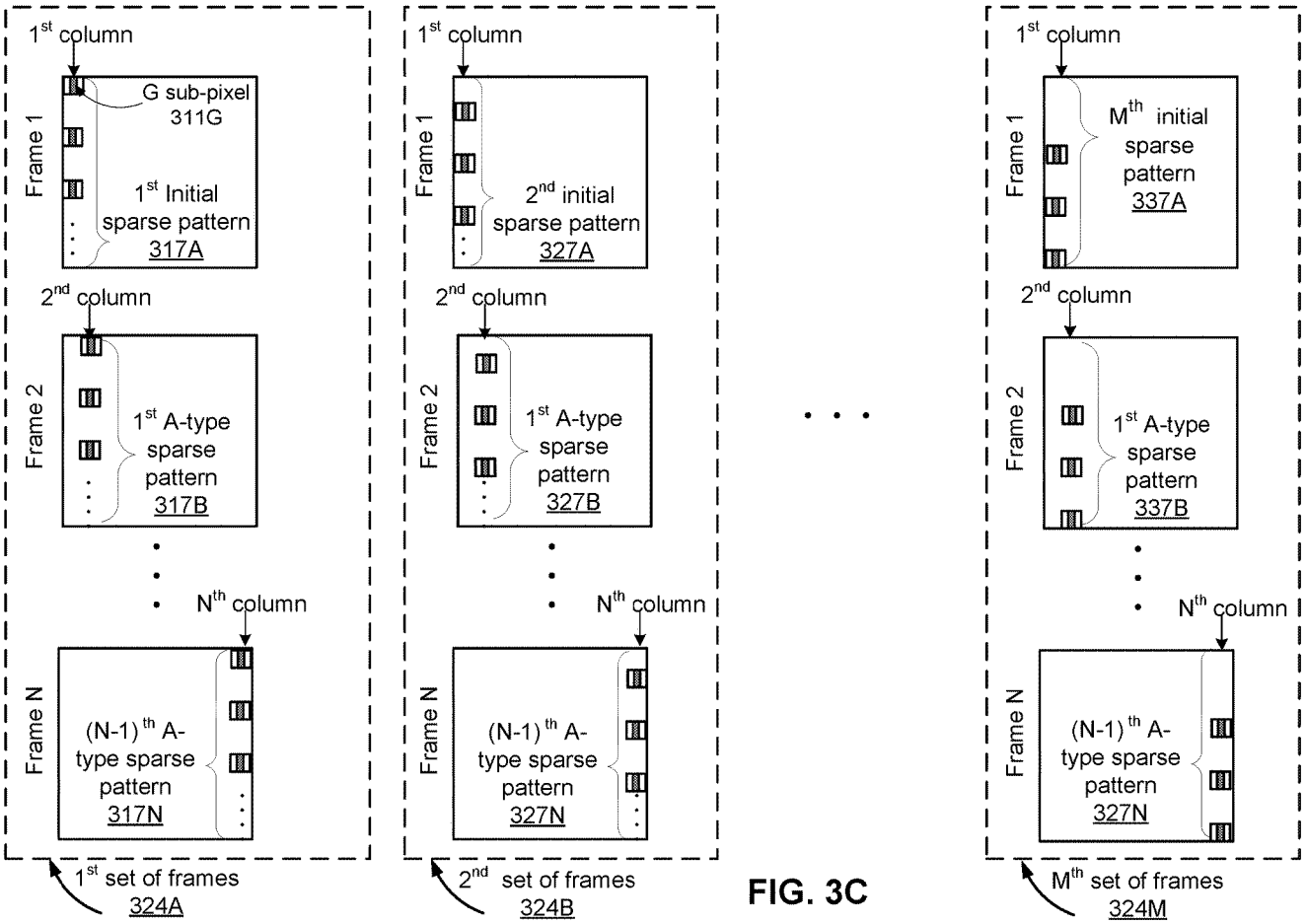
FIG. 3C is an example of a series of sparse patterns used in a plurality of sets of frames for sequentially activating all green sub-pixels within an electronic display in a rolling manner, in accordance with an embodiment.

FIG. 3C is an example of a series of sparse patterns ($1^{st}$ initial sparse pattern 317A, A-type sparse patterns 317B-317N based on the $1^{st}$ initial sparse pattern 317A, $2^{nd}$ initial sparse pattern 327A, A-type sparse patterns 327B-327N based on the $2^{nd}$ initial sparse pattern 327A, . . . , $M^{th}$ initial sparse pattern 337A, A-type sparse patterns 337B-337N based on the $M^{th}$ initial sparse pattern 337A) used in a plurality of sets of frames (e.g., $1^{st}$ set of frames 324A, $2^{nd}$ set of frames 324B, . . . , $M^{th}$ set of frames 324M) for sequentially activating all green sub-pixels within the electronic display 110 in a rolling manner, in accordance with an embodiment. Similar process shown in FIG. 3B can be applied to all green sub-pixels. Compared with FIG. 3B, instead of activating red sub-pixels, the display control module 220 instructs the electronic display 110 to activate green sub-pixels (as shown in hatch lines) in the series of parse patterns and in a rolling manner. The display control module 220 instructs a luminance detection device to measure luminance parameters of each active green sub-pixel.

Figure 3D:
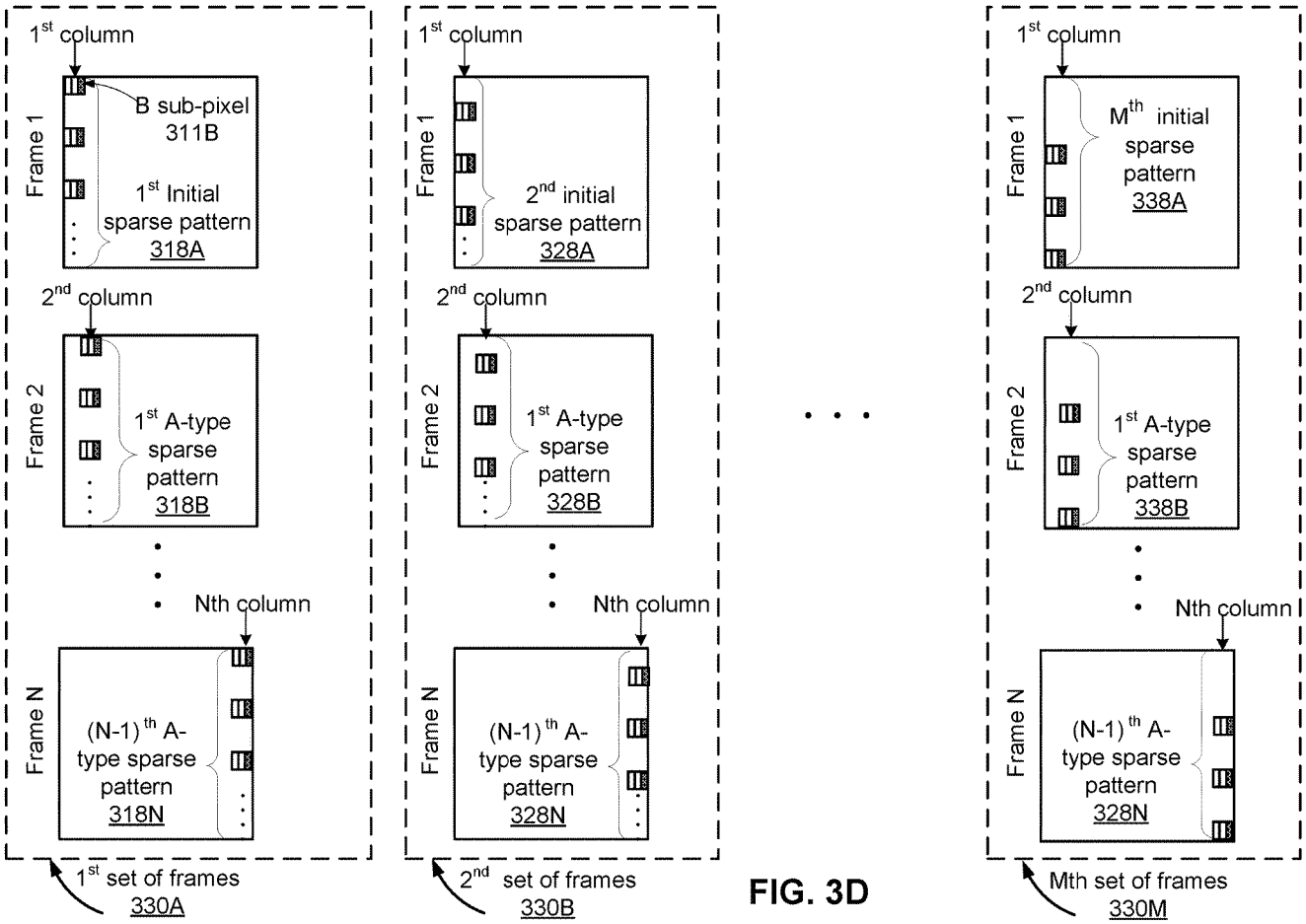
FIG. 3D is an example of a series of sparse patterns used in a plurality of sets of frames for sequentially activating all blue sub-pixels within an electronic display in a rolling manner, in accordance with an embodiment.

FIG. 3D is an example of a series of sparse patterns ($1^{st}$ initial sparse pattern 318A, A-type sparse patterns 318B-318N based on the $1^{st}$ initial sparse pattern 318A, $2^{nd}$ initial sparse pattern 328A, A-type sparse patterns 328B-328N based on the $2^{nd}$ initial sparse pattern 328A, . . . , $M^{th}$ initial sparse pattern 338A, A-type sparse patterns 338B-338N based on the $M^{th}$ initial sparse pattern 338A) used in a plurality of sets of frames (e.g., $1^{st}$ set of frames 330A, $2^{nd}$ set of frames 330B, . . . , $M^{th}$ set of frames 330M) for sequentially activating all blue sub-pixels within an electronic display 110 in a rolling manner, in accordance with an embodiment. Similar process shown in FIG. 3B can be applied to all blue sub-pixels. Compared with FIG. 3B, instead of activating red sub-pixels, the display control module 220 instructs the electronic display 110 to activate blue sub-pixels (as shown in hatch lines) in the series of sparse pattern and in a rolling manner. The display control module 220 instructs a luminance detection device to measure luminance parameters of each active blue sub-pixel.

Figure 3E:
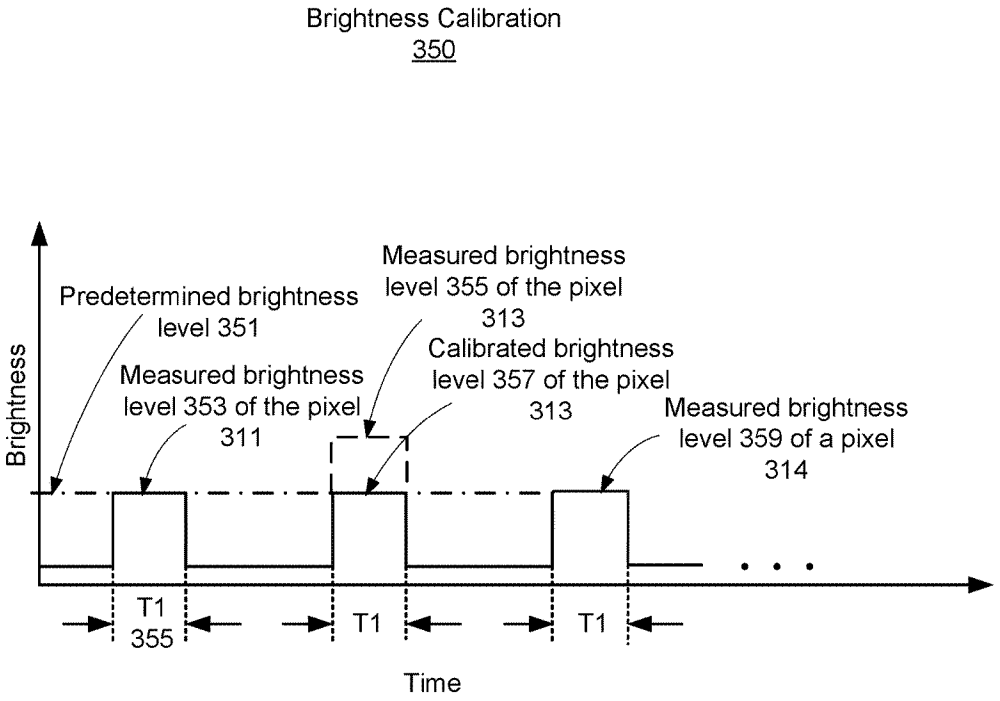
FIG. 3E is a diagram of a brightness calibration curve, in accordance with an embodiment.

FIG. 3E is a diagram of a brightness calibration curve 350, in accordance with an embodiment. The brightness calibration curve 350 describes brightness of each pixel activated in a rolling manner as a function of time. For example, the display control module 220 instructs the electronic device to activate the pixel 311 in the $1^{st}$ initial sparse pattern shown in FIG. 3A for a period of time (T1 355), and then stop activating the pixel 311. The display control module 220 instructs the luminance detection device to measure brightness level of the active pixel 311 during the period of time T1 355. As shown in FIG. 3E, the display calibration module 230 calculates difference between the measured brightness level 353 of the active pixel 311 and predetermined brightness level 351. The calculated difference indicates the measured brightness level 353 is within a range of brightness levels. In some embodiments, the display calibration module 230 does not calibrate the active pixel 311. In some embodiments, the display calibration module 230 determines calibration data that is the same as original data for driving the active pixel 311. The rolling, measuring, and calibrating process is repeated for the active pixels 313 and 314 sequentially. For the active pixel 314, the calculated difference indicates the measured brightness level 359 is within the range of brightness levels (e.g., 353 equals 351 shown in FIG. 3E). For the active pixel 313 the calculated difference indicates that the measured brightness level 355 deviates from corresponding predetermined brightness level 351 more or less than an associated threshold (e.g., 355 is higher than the 351 shown in FIG. 3E). The display calibration module 230 determines calibration data based on the calculated difference to adjust the brightness level of the active pixel 313. After calibration, the calibrated brightness level 357 of the pixel 313 is within the range of brightness levels.

Figure 3F:
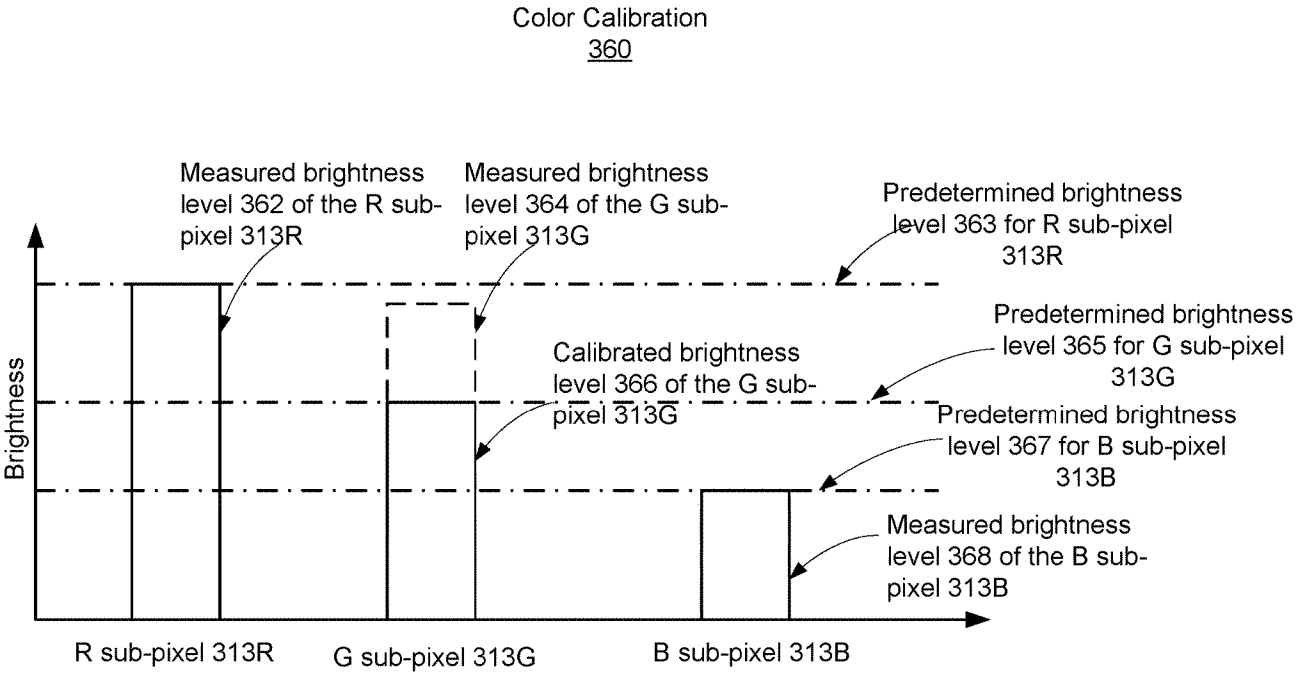
FIG. 3F is a diagram of color calibration curve, in accordance with an embodiment.

FIG. 3F is a diagram of a color calibration curve 360, in accordance with an embodiment. The calibration curve 360 describes brightness of each active sub-pixels (e.g., R sub-pixel 313R, G sub-pixel 313G, and B sub-pixel 313B) in the pixel 313. Brightness of each of the active sub-pixels are merged to represent a color of the pixel 313. For example, a predetermined color for the pixel 313 could be orange, which consists of a predetermined brightness level 363 for R sub-pixel 313R, a predetermined brightness level 365 for G sub-pixel 313G, and a predetermined brightness level 367 for B sub-pixel 313B. As shown in FIG. 3F, the measured brightness level 364 of the G sub-pixel 313G is higher than the predetermined brightness 365. A measured color of the pixel could be, e.g., yellow. The display calibration module 230 calculates difference between the measured brightness level 364 of the G sub-pixel 313G and the predetermined brightness level 365 and difference between the color of the pixel 313 (e.g. yellow) and the predetermined color (e.g. orange). The display calibration module 230 determines calibration data based on the=calculated differences. The display calibration module 230 may balance calibration data of brightness and color to adjust both brightness level and color such that the brightness level and color of the pixel 313 is within a range of brightness levels and colors. The display calibration module 230 may calibrate the brightness level based on the color, or vice versa. The display calibration module 230 may weight calibration data of brightness and color. As shown in FIG. 3F, after calibration, the calibrated brightness level 363 of the G sub-pixel 313G is located at the predetermined brightness level 365 to represent organ color within an acceptable range.

Figure 4:
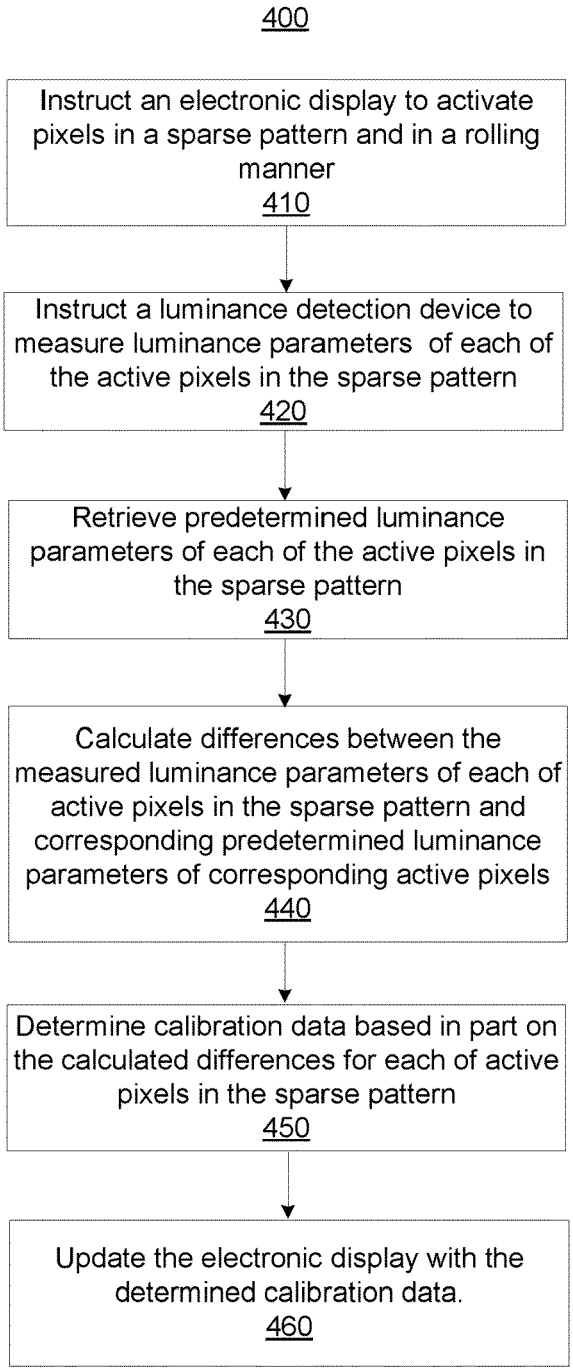
FIG. 4 is a flowchart illustrating a process for calibrating luminance of an electronic display, in accordance with an embodiment.

FIG. 4 is a flowchart illustrating a process 400 for calibrating luminance of an electronic display, in accordance with an embodiment. The process 400 may be performed by the system 100 in some embodiments. Alternatively, other components may perform some or all of the steps of the process 400. Additionally, the process 400 may include different or additional steps than those described in conjunction with FIG. 4 in some embodiments or perform steps in different orders than the order described in conjunction with FIG. 4.

The system 100 instructs 410 an electronic display to activate pixels in a sparse pattern and in a rolling manner. For example, the controller 140 of the system 100 generates instructions to instruct the electronic display 110 to activate pixels included in the electronic display 100 in a sparse pattern and in a rolling manner, as described above in conjunction with FIGS. 2 and 3A.

The system 100 instructs 420 a luminance detection device to measure luminance parameters of each of the active pixels in the sparse pattern. For example, the controller 140 of the system 100 generates instructions to instruct the luminance detection device 130 to measure a brightness level, or a color, or both of an active pixel in the sparse pattern, while the active pixel is displayed, as described above in conjunction with FIGS. 2 and 3A.

The system 100 retrieves 430 predetermined luminance parameters of each of the active pixels in the sparse pattern. For example, the system 100 retrieves a predetermined brightness level, or a predetermined color, or both of the active pixel that has been measured by the luminance detection device 130.

The system 100 calculates 440 differences between the measured luminance parameters of each of active pixels in the sparse pattern and corresponding predetermined luminance parameters of corresponding active pixels. Examples of the luminance parameters of the active pixel may include brightness level, color value, or both. In some embodiments, the system 100 may determine a luminance quality to check if differences between calibrated luminance parameters of the active pixel and predetermined luminance parameters are within the acceptable ranges.

The system 100 determines 450 calibration data based in part on the calculated differences for each of active pixels in the sparse pattern. For example, the system 100 determines calibration data to adjust the measured luminance parameters of the active pixel such that the corresponding calibrated luminance parameters of the active pixel are within the acceptable ranges.

In another example, the system 100 determines a luminance quality to check if differences between measured luminance parameters of the active pixel and the corresponding predetermined luminance parameters of the active pixel are within the acceptable ranges. If the determined luminance quality indicates the measured luminance parameters of the active pixel deviate from the corresponding predetermined luminance parameters of the active pixel more or less than an associated threshold, the system 100 determines the calibration data based on calculated differences. For example, compared with the predetermined brightness level, the measured brightness level is outside of a range of brightness level. Compared with the predetermined color value, the measured color value is outside of a range of colors values. If the determined luminance quality indicates the measured luminance parameters of the active pixel are within the acceptable ranges, the system 100 determines the calibration data that is the same as original data for driving the active pixel. In such way, the system 100 may determine calibration data for all the pixels. In some embodiments, the system 100 may skip the step for determining the calibration data. The system 100 instructs the electronic display to activate another active pixel in the sparse pattern. In such way, the system 100 determines calibration data for portions of the pixels included in the electronic display 110.

The system 100 updates 460 the electronic display with the determined calibration data. For example, the system 100 generates instructions to instruct the electronic display to display the active pixel using the calibration data.

In some embodiments, the system 100 may calibrate luminance parameters (e.g., brightness level, color, or both) of sub-pixels by activating sub-pixels in a sparse pattern and in a rolling manner, examples are described above in conjunction with FIGS. 3B-3D.

In some embodiments, the system 100 may calibrate luminance parameters of sections each including a group of pixels. Compared with calibrating luminance parameters of sections each including a pixel as described in conjunction with FIGS. 3A and 4, the sparse pattern includes a plurality of sections in a particular direction (e.g., a vertical direction) that are separated from each other by a threshold distance. The system 100 instructs the electronic display 110 to activate sections in a sparse pattern and in a rolling manner, instead of pixels. The system 100 instructs the luminance detection device 130 to measure luminance parameters of each of the active sections in the sparse pattern. Examples of luminance parameters of a section includes a brightness level of the section (e.g., an averaged brightness level from brightness level of each pixel included in the section), a color of the section (e.g., an averaged color from color of each pixel included in the section), or both. The system 100 retrieves predetermined luminance parameters of each of the active sections in the sparse pattern. The predetermined luminance parameters of each section are stored in database 210. The system 100 calculates differences between the measured luminance parameters of each of active sections in the sparse pattern and corresponding predetermined luminance parameters of corresponding active sections. The system 100 determines calibration data based in part on the calculated differences for each of active sections in the sparse pattern. The determined calibration data may include a correction drive voltage of the TFT that drives each pixel included in the section. For example, the system 100 determines a correction drive voltage based on the calculated differences associated with the section. The system 100 applies the determined correction drive voltage for each pixel included in the section. The system 100 updates the electronic display with the determined calibration data. In some embodiments, the system 100 may determine a luminance quality to check if differences between calibrated luminance parameters of the active section and predetermined luminance parameters are within the acceptable ranges.

Example Application of Display Calibration in a Head Mounted Display

Figure 5A:
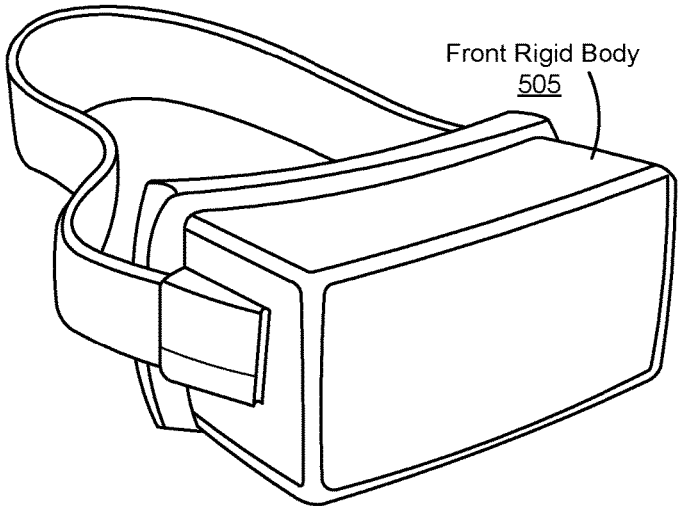
FIG. 5A is a diagram of a headset, in accordance with an embodiment.

FIG. 5A is a diagram of a headset 500, in accordance with an embodiment. The headset 500 is a Head-Mounted Display (HMD) that presents content to a user. Example content includes images, video, audio, or some combination thereof. Audio content may be presented via a separate device (e.g., speakers and/or headphones) external to the headset 500 that receives audio information from the headset 500. In some embodiments, the headset 500 may act as a VR headset, an augmented reality (AR) headset, a mixed reality (MR) headset, or some combination thereof. In embodiments that describe AR system environment, headset 500 augments views of a physical, real-world environment with computer-generated elements (e.g., images, video, sound, etc.). For example, the headset 500 may have at least a partially transparent electronic display. In embodiments that describe MR system environment, the headset 500 merges views of physical, real-word environment with virtual environment to produce new environments and visualizations where physical and digital objects co-exist and interact in real time. The headset 500 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other. As shown in FIG. 5A, the headset 500 has a front rigid body 505 to hold an electronic display, optical system, and electronics, as further described in FIG. 5B.

Figure 5B:
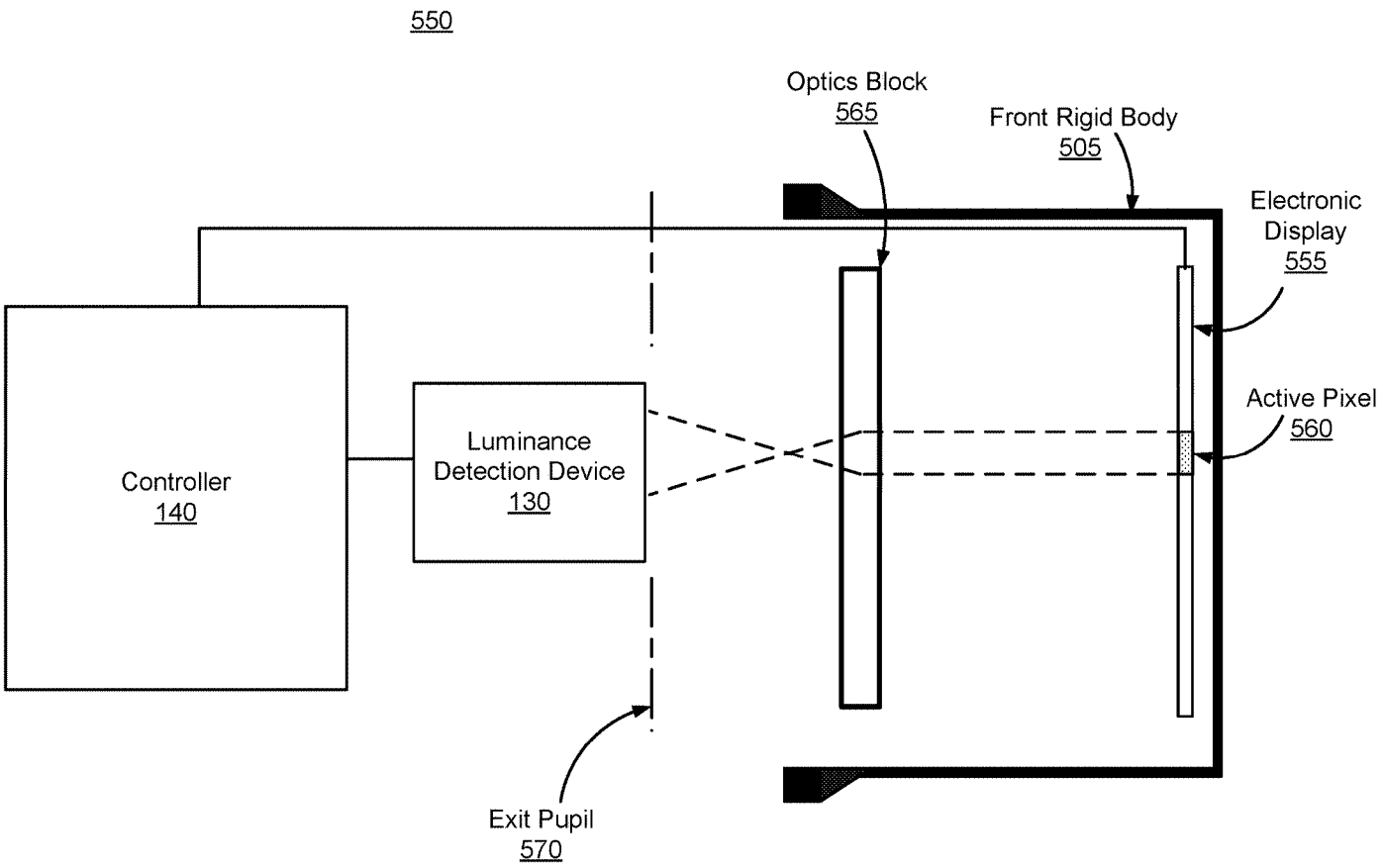
FIG. 5B is a cross-section view of headset in FIG. 5A connected with a controller and a luminance detection device, in accordance with an embodiment.

FIG. 5B is a cross-section view of headset in FIG. 5A connected with a controller 140 and a luminance detection device 130, in accordance with an embodiment. The headset 500 includes an electronic display 555, and an optics block 565. The electronic display 555 displays images to the user in accordance with data received from controller 140, or an external source. In some embodiments, the electronic display has two separate display panels, one for each eye.

The optics block 565 magnifies received light, corrects optical errors associated with the image light, and presents the corrected image light to a user of the headset 500. In various embodiments, the optics block 565 includes one or more optical elements. Example optical elements included in the optics block 565 include: an aperture, a Fresnel lens, a convex lens, a concave lens, a filter, or any other suitable optical element that affects image light. Moreover, the optics block 565 may include combinations of different optical elements. In some embodiments, one or more of the optical elements in the optics block 565 may have one or more coatings, such as antireflective coatings. The optics block 565 directs the image light to an exit pupil 570 for presentation to the user. The exit pupil 570 is the location of the front rigid body 505 where a user's eye is positioned.

To calibrate the electronic display 555 in the headset 500, as shown in FIG. 5B, the luminance detection device 130 is placed at the exit pupil 570. The controller 140 instructs the electronic display 555 to activate pixels in a sparse pattern and in rolling manner, as descried above. The luminance detection device 130 measures luminance parameters (e.g., brightness, or color, or both) of the active pixel 560 via the optical block 565. In some embodiments, the luminance detection device 130 measures luminance parameters (e.g., brightness, or color, or both) of the active pixel 560 through an eyecup assembly for each eye. The optics block 565 includes an eyecup assembly for each eye. Each eyecup assembly includes a lens and is configured to receive image light from the electronic display 555 and direct the image light to the lens, which directs the image light to the luminance detection device 130. In some embodiments, one or more of the eyecup assemblies are deformable, so an eyecup assembly may be compressed or stretched to, respectively, increase or decrease the space between an eye of the user and a portion of the eyecup assembly. The controller 140 calculates differences between the measured luminance parameters of the active pixel 560 in the sparse pattern and corresponding predetermined luminance parameters of the active pixel 560. The controller 140 determines calibration data based in part on the calculated differences for the active pixel 560 in the sparse pattern. In some embodiments, the controller determines a luminance quality based on the calculated differences of the active pixel 560. If the determined luminance quality indicates the measured luminance parameters of the active pixel 560 deviate from corresponding predetermined luminance parameters of the active pixel 560 more or less than an associated threshold, the controller 140 determines calibration data for the active pixel 560. The controller 140 updates the electronic display with the determined calibration data to calibrate the active pixel 560. If the determined luminance quality indicates the measured luminance parameters of the active pixel 560 are within an acceptable range, the controller 140 may skip the step for determining calibration data and the controller 140 instructs the electronic display 555 to activate another active pixel in the sparse pattern. In some embodiments, the controller 140 determines calibration data that is the same as the original data for driving the active pixel 560

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights.

What is claimed is:

1. A system comprising:

a one-dimensional photo-detector configured to measure luminance parameters of pixels of an electronic display, wherein the electronic display includes a plurality of columns of pixels and the luminance parameters include a brightness level for each of the measured pixels; and a controller configured to:

instruct the electronic display to activate the pixels of the electronic display using a plurality of sparse patterns and each sparse pattern describes a respective subset of pixels within a single respective column, and for each sparse pattern:

there is a fixed number of inactive pixels between adjacent active pixels in the single respective column, the respective subset of pixels within the respective column is sequentially presented in a rolling manner such that no two pixels of the electronic display are active over a same time period, and the respective subset of pixels in the single respective column described by the sparse pattern are activated before advancing to another sparse pattern that describes a subset of pixels in an adjacent column, instruct the one-dimensional photo-detector to measure luminance parameters for each of the pixels in each of the plurality of sparse patterns, and generate calibration data based on the measured luminance parameters of the pixels in each of the plurality of sparse patterns, the calibration data including a brightness level adjustment to one or more of the pixels such that corresponding brightness levels of the one or more pixels are within a predetermined range of brightness levels.

2. The system of claim 1, wherein the controller is further configured to:

update the electronic display with the determined calibration data.

3. The system of claim 1, wherein the luminance parameters further comprise color wavelength values corresponding to light output from each of the measured pixels.

4. The system of claim 1, wherein the calibration data further includes a color adjustment to one or more of the pixels such that the colors values of corresponding pixels are within a predetermined range of color values.

5. The system of claim 4, wherein the brightness level adjustment is based in part on the color adjustment.

6. The system of claim 1, wherein the one-dimensional photo-detector is a photodiode.

7. The system of claim 1, wherein the controller is further configured to:

retrieve predetermined luminance parameters of each of the pixels in a sparse pattern of the plurality of sparse patterns;

calculate differences between the measured luminance parameters of each of pixels in the sparse pattern and corresponding predetermined luminance parameters of corresponding pixels; and determine calibration data based in part on the calculated differences for each of pixels in the sparse pattern.

8. The system of claim 7, wherein the controller is further configured to:

determine a luminance quality based in part on the calculated differences.

9. The system of claim 8, wherein the controller is further configured to:

determine calibration data based on the calculated differences, responsive to the determined luminance quality indicating that the measured luminance parameters of the pixels deviate from corresponding predetermined luminance parameters of the corresponding pixels.

10. The system of claim 1, wherein each pixel includes a plurality of sub-pixels.

11. A method comprising:

activating pixels of an electronic display using a plurality of sparse patterns, the electronic display includes a plurality of columns of pixels and each sparse pattern describes a respective subset of pixels in a particular direction within a single respective column, and for each sparse pattern:

there is a fixed number of inactive pixels between adjacent active pixels in the single respective column, the respective subset of pixels within the respective column is sequentially presented in a rolling manner such that no two pixels of the electronic display and are active over a same time period, and the respective subset of pixels in the single respective column described by the sparse pattern are activated before advancing to another sparse pattern that describes a subset of pixels in an adjacent column;

measuring, by a one-dimensional photo-detector, luminance parameters for each of the pixels of the electronic display and, the luminance parameters include a brightness level for each of the measured pixels; and determining calibration data based on the luminance parameters of the pixels in each of the plurality of sparse patterns measured by the one-dimensional photo-detector, the calibration data including a brightness adjustment to one or more pixels such that brightness levels of corresponding pixels are within a range of brightness levels.

12. The method of claim 11, further comprising updating the electronic display with the determined calibration data.

13. The method of claim 11, wherein the luminance parameters further comprise color wavelength values corresponding to light output from each of the measured pixels.

14. The method of claim 11, wherein the calibration data further includes a color adjustment to one or more of the pixels such that the colors values of corresponding pixels are within a predetermined range of color values.

15. The method of claim 11, wherein each pixel includes a plurality of sub-pixels.

16. A system comprising:

a one-dimensional photo-detector configured to measure luminance parameters of pixels of an electronic display, wherein the electronic display includes a plurality of columns of pixels and the luminance parameters include a brightness level and a color for each of the measured pixels, wherein each pixel is composed of a plurality of sub-pixels types, where different types of sub-pixels are configured to emit light at different colors of light; and a controller configured to:

instruct the electronic display to activate sub-pixels of the same color type in the pixels of the electronic display using a plurality of sparse patterns and each sparse pattern describes a respective subset of sub-pixels within a single respective column, and for each sparse pattern:

there is a fixed number of inactive pixels between adjacent active pixels in the single respective column, the respective subset of sub-pixels within the respective column is sequentially presented in a rolling manner such that no two sub-pixels of the electronic display are active over a same time period, and the respective subset of pixels in the single respective column described by the sparse pattern are activated before advancing to another sparse pattern that describes a subset of pixels in an adjacent column, instruct the one-dimensional photo-detector to measure luminance parameters for each of the pixels in each of the plurality of sparse patterns, and generate calibration data based on the measured luminance parameters of the pixels in each of the plurality of sparse patterns, the calibration data including a brightness level adjustment to one or more of the pixels such that brightness levels of corresponding pixels are within a range of brightness levels, and a color adjustment to one or more of the pixels is such that colors of corresponding pixels are within a range of colors.

* * * * *